US008366251B2

(12) United States Patent
Wanibe et al.

(10) Patent No.: US 8,366,251 B2
(45) **Date of Patent: *Feb. 5, 2013**

(54) LIQUID CONTAINER, METHOD OF FILLING LIQUID INTO LIQUID CONTAINER, AND REMANUFACTURING METHOD OF LIQUID CONTAINER

(75) Inventors: Akihisa Wanibe, Matsumoto (JP); Taku Ishizawa, Shiojiri (JP); Satoshi Shinada, Shiojiri (JP); Chiaki Miyajima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 424 days.

This patent is subject to a terminal disclaimer.

(21) Appl. No.: 12/509,233

(22) Filed: Jul. 24, 2009

(65) Prior Publication Data

US 2009/0322832 A1 Dec. 31, 2009

Related U.S. Application Data

(63) Continuation-in-part of application No. 12/490,876, filed on Jun. 24, 2009, which is a continuation-in-part of application No. 12/490,935, filed on Jun. 24, 2009, now Pat. No. 8,177,342, which is a continuation-in-part of application No. 12/490,985, filed on Jun. 24, 2009, now Pat. No. 8,142,000.

(30) Foreign Application Priority Data

Jun. 27, 2008 (JP) ..... 2008-169048
Jun. 27, 2008 (JP) ..... 2008-169071
Jun. 27, 2008 (JP) ..... 2008-169090

(51) Int. Cl.
*B41J 2/175* (2006.01)

(52) U.S. Cl. ..... 347/86

(58) Field of Classification Search ..... 347/7, 49, 347/85, 86, 92; 141/2, 18
See application file for complete search history.

(56) References Cited

U.S. PATENT DOCUMENTS 6,848,776 B2 2/2005 Nishioka et al.
7,165,835 B2 1/2007 Ota et al.
2008/0034712 A1 2/2008 Miyajima et al.
2008/0088652 A1 4/2008 Miyajima et al.
2008/0094456 A1 4/2008 Miyajima et al.
(Continued)

FOREIGN PATENT DOCUMENTS

CN 101121336 A 2/2008
EP 1 886 823 A2 2/2008
(Continued)

OTHER PUBLICATIONS

Office Action dated Jul. 20, 2011 received in U.S. Appl. No. 12/490,985.

(Continued)

*Primary Examiner* — Anh T. N. Vo
(74) *Attorney, Agent, or Firm* — Stroock & Stroock & Lavan LLP

(57) ABSTRACT

According to one aspect of the invention, a remanufacturing method of a liquid container forms an inlet in a certain area, for example, a buffer chamber, other than a specific section including liquid reservoirs and flow paths adjoining to and directly communicating with a bubble trap flow path in the liquid container. In the state of closing a liquid feeder and opening an air open structure, the remanufacturing method injects a liquid through the inlet to fill a space in the upstream of the inlet with the liquid. In the state of opening the liquid feeder and closing the air open structure, the remanufacturing method injects the liquid through the inlet to fill a space in the downstream of the inlet with the liquid. The remanufacturing process seals the inlet after completion of the injection of the liquid. This arrangement enables the liquid to be refilled into the liquid container without damaging the functions of the liquid container.

6 Claims, 21 Drawing Sheets

U.S. PATENT DOCUMENTS

| | | | |
|---|---|---|---|
| 2009/0015644 | A1 | 1/2009 | Shinada et al. |
| 2009/0322838 | A1 | 12/2009 | Wanibe et al. |
| 2009/0322839 | A1 | 12/2009 | Ishizawa et al. |
| 2010/0073438 | A1 | 3/2010 | Wanibe et al. |

FOREIGN PATENT DOCUMENTS

| | | | |
|---|---|---|---|
| JP | 2006175789 | A | 7/2006 |
| JP | 2007-508160 | | 4/2007 |
| JP | 2008-044184 | | 2/2008 |
| JP | 2008-044185 | | 2/2008 |
| JP | 2008-044186 | | 2/2008 |
| JP | 2008-044190 | | 2/2008 |
| JP | 2008-044192 | | 2/2008 |
| JP | 2008-044193 | | 2/2008 |
| JP | 2008-044195 | | 2/2008 |
| JP | 2008-044198 | | 2/2008 |
| JP | 2008-068614 | | 3/2008 |
| WO | WO 2005032825 | | 4/2005 |

OTHER PUBLICATIONS

Office Action dated Jul. 12, 2011 received in U.S. Appl. No. 12/490,935.

Office Action dated Jul. 8, 2011 received in U.S. Appl. No. 12/490,876.

Office Action dated Nov. 9, 2011 received in U.S. Appl. No. 12/490,935.

Office Action dated Nov. 8, 2011 received in U.S. Appl. No. 12/490,876.

LIQUID CONTAINER, METHOD OF FILLING LIQUID INTO LIQUID CONTAINER, AND REMANUFACTURING METHOD OF LIQUID CONTAINER

CROSS-REFERENCE TO RELATED APPLICATIONS

This application is a continuation-in-part of copending application Ser. Nos. 12/490,876, 12/490,935 and 12/490,985, all filed Jun. 24, 2009, the contents of which are incorporated herein by reference.

BACKGROUND

1. Field of the Invention

The present invention relates to a liquid refill technique of refilling a liquid into a liquid container structured to store the liquid, which is to be supplied to a liquid consuming device.

2. Description of the Related Art

In ink-jet printers, in response to detection of out-of-ink with consumption of ink stored in an ink cartridge, the used ink cartridge is generally replaced with a new ink cartridge. As ink cartridges are recycled, more active approaches for the more efficient use of resources have been demanded and discussed. One approach refills ink into the used ink cartridge. Some techniques have been proposed for ink refill in the ink cartridge as disclosed in, for example, Japanese Patent Laid-Open No. 2007-508160.

The ink refill technique disclosed in this cited reference seals an ink outlet of the ink cartridge with a plug, drills or otherwise bores a through hole in the outer wall surface of the ink cartridge, refills ink via the through hole into an ink reservoir assembly by means of an injector, and seals the through hole after the ink refill. This prior art ink refill technique expects the air remaining in the ink cartridge to be naturally discharged out via the through hole designed to have a larger diameter than the diameter of the injector during the ink refill.

The ink refill technique disclosed in the cited reference seals the ink outlet and causes the air remaining in the ink cartridge to be discharged out via the through hole during the ink refill as mentioned above. This structure interferes with the ink flowing into a pathway between the ink reservoir assembly and the ink outlet and accordingly does not attain the efficient ink refill. The ink refill technique of the above cited reference is not simply applicable to ink cartridges of the complicated and advanced internal structure. For example, in an ink cartridge equipped with a sensor unit including an ink sensor that utilizes a piezoelectric element to detect the level of remaining ink, the ink flow path structure is especially complicated to avoid false detection of the ink sensor caused by migration of the air into the sensor unit. Formation of the through hole naturally produces some shavings of the cartridge casing, which may be mixed into the ink stored in the ink cartridge and may damage the functions of the ink cartridge.

This problem is not characteristic of the ink cartridge for the printer but is commonly found in diversity of liquid containers used for supplying a liquid to a liquid consuming device, for example, a liquid container for supplying a metal-containing liquid material to an injection device designed to inject the liquid material onto a semiconductor substrate and thereby form an electrode layer on the semiconductor substrate.

SUMMARY

By taking into account the drawbacks discussed above, there would be a demand for refilling a liquid into a liquid container without damaging the functions of the liquid container. The present invention accomplishes at least part of the demand mentioned above and the other relevant demands by variety of configurations discussed below.

One aspect of the invention is directed to a liquid filling method of filling a liquid into a liquid container designed to be attachable to and detachable from a liquid consuming device and to store the liquid, which is to be supplied to the liquid consuming device. The liquid container is structured to include: a first chamber arranged to store the liquid therein; a second chamber located in the downstream of the first chamber or at a closer side to the liquid consuming device in a pathway of the liquid and arranged to communicate with the first chamber and store the liquid therein; a sensor unit located in the downstream of the second chamber and arranged to receive therein a sensor used for detecting a consumption level or a remaining level of the liquid; a liquid feeder located in the downstream of the sensor unit and arranged to supply the liquid stored in the first chamber and in the second chamber to the liquid consuming device; an air open structure arranged to connect the first chamber with the outside air via an air communication path; a bubble trap flow path located in the upstream of the sensor unit and in the downstream of the second chamber, formed to have cylindrical flow paths turned down upward in a certain attitude of the liquid container attached to the liquid consuming device, and designed to trap bubbles; and a bubble trap chamber located in the downstream of the bubble trap flow path and in the upstream of the sensor unit and designed to trap bubbles. The liquid filling method forms an inlet in an area other than a specific section adjoining to and directly communicating with the bubble trap flow path in the pathway of the liquid. The liquid filling method injects the liquid through the inlet and seals the inlet after the injection of the liquid.

The liquid filling method according to this aspect of the invention fills the liquid into the area other than the specific section adjoining to and directly communicating with the bubble trap flow path in the pathway of the liquid. Even if the shavings of the liquid container produced in the course of formation of the inlet are mixed into the liquid inside the liquid container, the location of shaving contamination is not adjacent to the bubble trap flow path and thus effectively prevents the shavings mixed into the liquid from reaching the bubble trap flow path. This arrangement desirably prevents the blockage of the bubble trap flow path or the increasing flow resistance of the bubble trap flow path due to accumulation of the shavings in the bubble trap flow path. This arrangement also prevents the occurrence of edges in the cylindrical flow paths due to accumulation of the shavings in the bubble trap flow path and thereby maintains the liquid backflow control mechanism. The liquid filling method of this aspect ensures the liquid refill without damaging the functions of the liquid container. In the specification thereof, the terminology 'specific section adjoining to and directly communicating with the bubble trap flow path' includes any of various chambers and flow paths for the liquid defined by the inner walls in the pathway of the liquid.

Another aspect of the invention is also directed to a remanufacturing method of a liquid container designed to be attachable to and detachable from a liquid consuming device and to store a liquid, which is to be supplied to the liquid consuming device. The remanufacturing method provides the liquid container structured to include: a first chamber arranged to store the liquid therein; a second chamber located in the downstream of the first chamber or at a closer side to the liquid consuming device in a pathway of the liquid and arranged to communicate with the first chamber and store the liquid therein; a sensor unit located in the downstream of the second chamber and arranged to receive therein a sensor used for detecting a consumption level or a remaining level of the liquid; a liquid feeder located in the downstream of the sensor unit and arranged to supply the liquid stored in the first chamber and in the second chamber to the liquid consuming device; an air open structure arranged to connect the first chamber with the outside air via an air communication path; a bubble trap flow path located in the upstream of the sensor unit and in the downstream of the second chamber, formed to have cylindrical flow paths turned down upward in a certain attitude of the liquid container attached to the liquid consuming device, and designed to trap bubbles; and a bubble trap chamber located in the downstream of the bubble trap flow path and in the upstream of the sensor unit and designed to trap bubbles. The remanufacturing method forms an inlet in an area other than a specific section adjoining to and directly communicating with the bubble trap flow path in the pathway of the liquid. The remanufacturing method injects the liquid through the inlet and seals the inlet after the injection of the liquid.

Like the liquid filling method discussed above, the remanufacturing method according to this aspect of the invention remanufactures the liquid container without damaging the functions of the liquid container.

Another aspect of the invention is further directed to a liquid container constructed to be attachable to and detachable from a liquid consuming device and to store a liquid, which is to be supplied to the liquid consuming device. The liquid container includes: a first chamber arranged to store the liquid therein; a second chamber located in the downstream of the first chamber or at a closer side to the liquid consuming device in a pathway of the liquid and arranged to communicate with the first chamber and store the liquid therein; a sensor unit located in the downstream of the second chamber and arranged to receive therein a sensor used for detecting a consumption level or a remaining level of the liquid; a liquid feeder located in the downstream of the sensor unit and arranged to supply the liquid stored in the first chamber and in the second chamber to the liquid consuming device; an air open structure arranged to connect the first chamber with the outside air via an air communication path; a bubble trap flow path located in the upstream of the sensor unit and in the downstream of the second chamber, formed to have cylindrical flow paths turned down upward in a certain attitude of the liquid container attached to the liquid consuming device, and designed to trap bubbles; a bubble trap chamber located in the downstream of the bubble trap flow path and in the upstream of the sensor unit and designed to trap bubbles; an inlet formed in an area other than a specific section, such as a chamber or a flow path, adjoining to and directly communicating with the bubble trap flow path in the pathway of the liquid to allow injection of the liquid; and a sealing member structured to seal the inlet.

The liquid container according to this aspect of the invention has the effects discussed above in the liquid filling process. Sealing the inlet with the sealing member does not damage the functions of the liquid container. The liquid refill through the inlet is easily performed many times by the simple removal of the sealing member.

DESCRIPTION OF THE PREFERRED EMBODIMENTS

Figure 1:
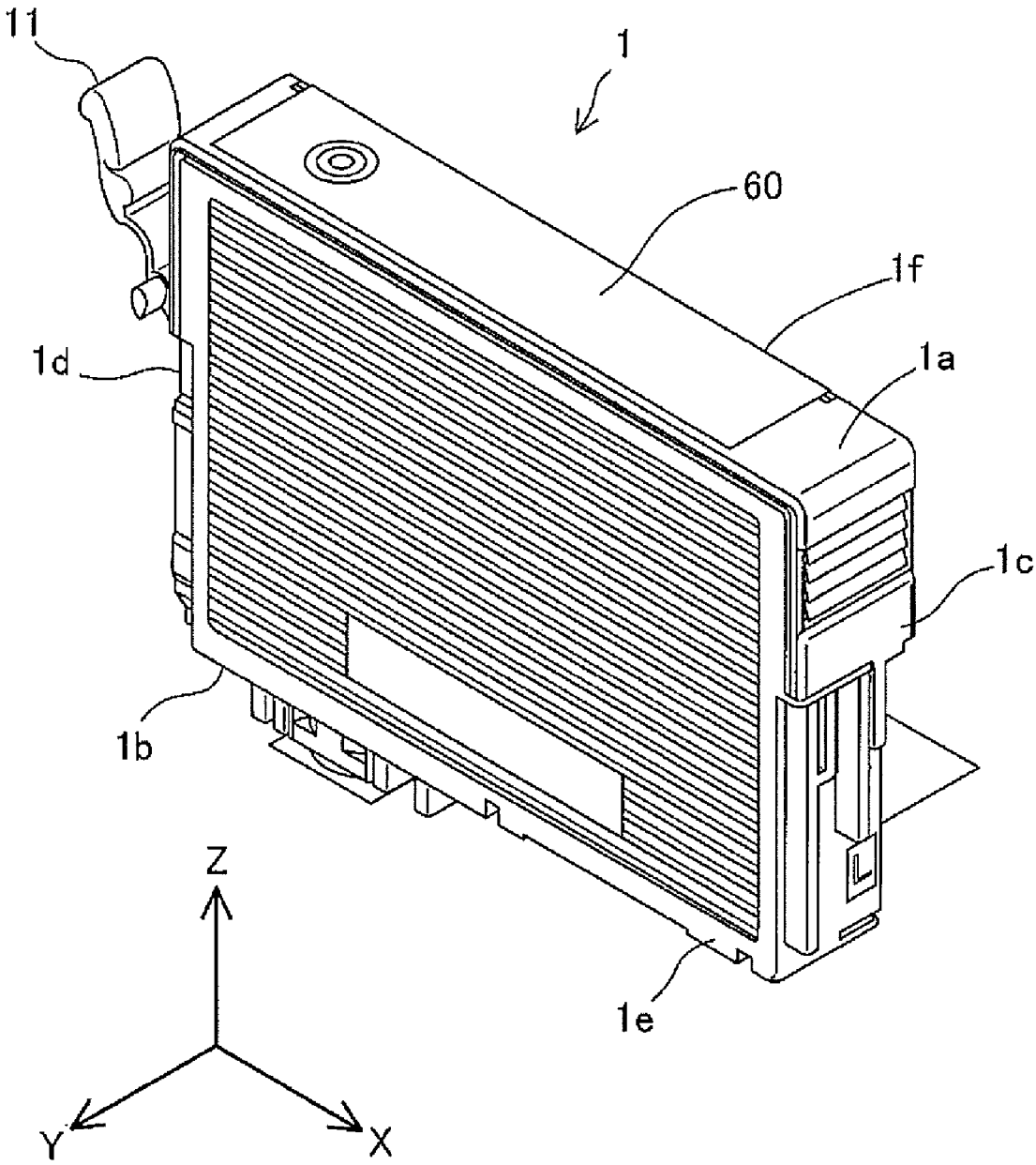
FIG. 1 is a perspective view showing the appearance of an ink cartridge in one embodiment of the invention, seen from one direction.
Figure 2:
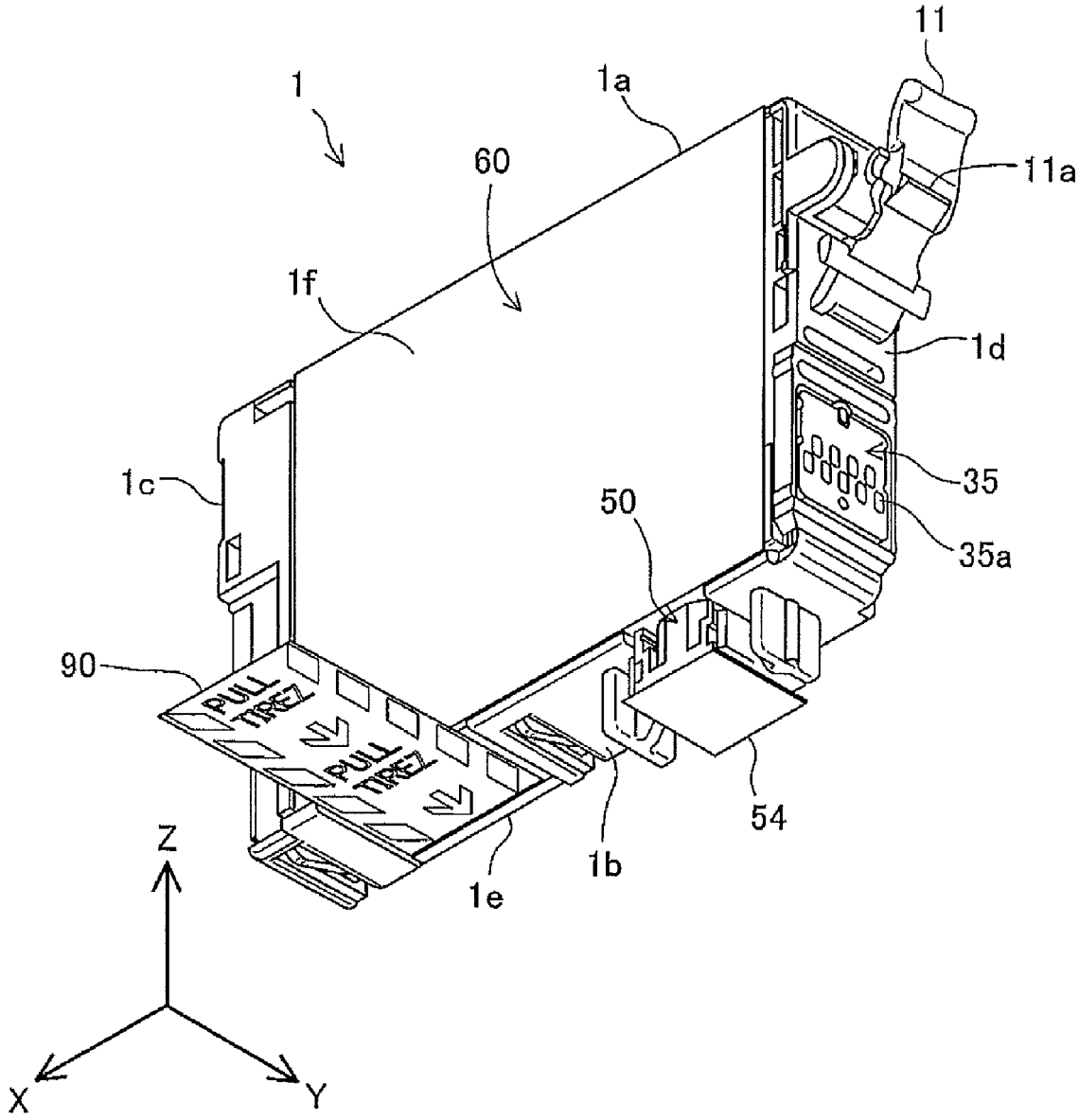
FIG. 2 is a perspective view showing the appearance of the ink cartridge of the embodiment, seen from another direction.
Figure 3:
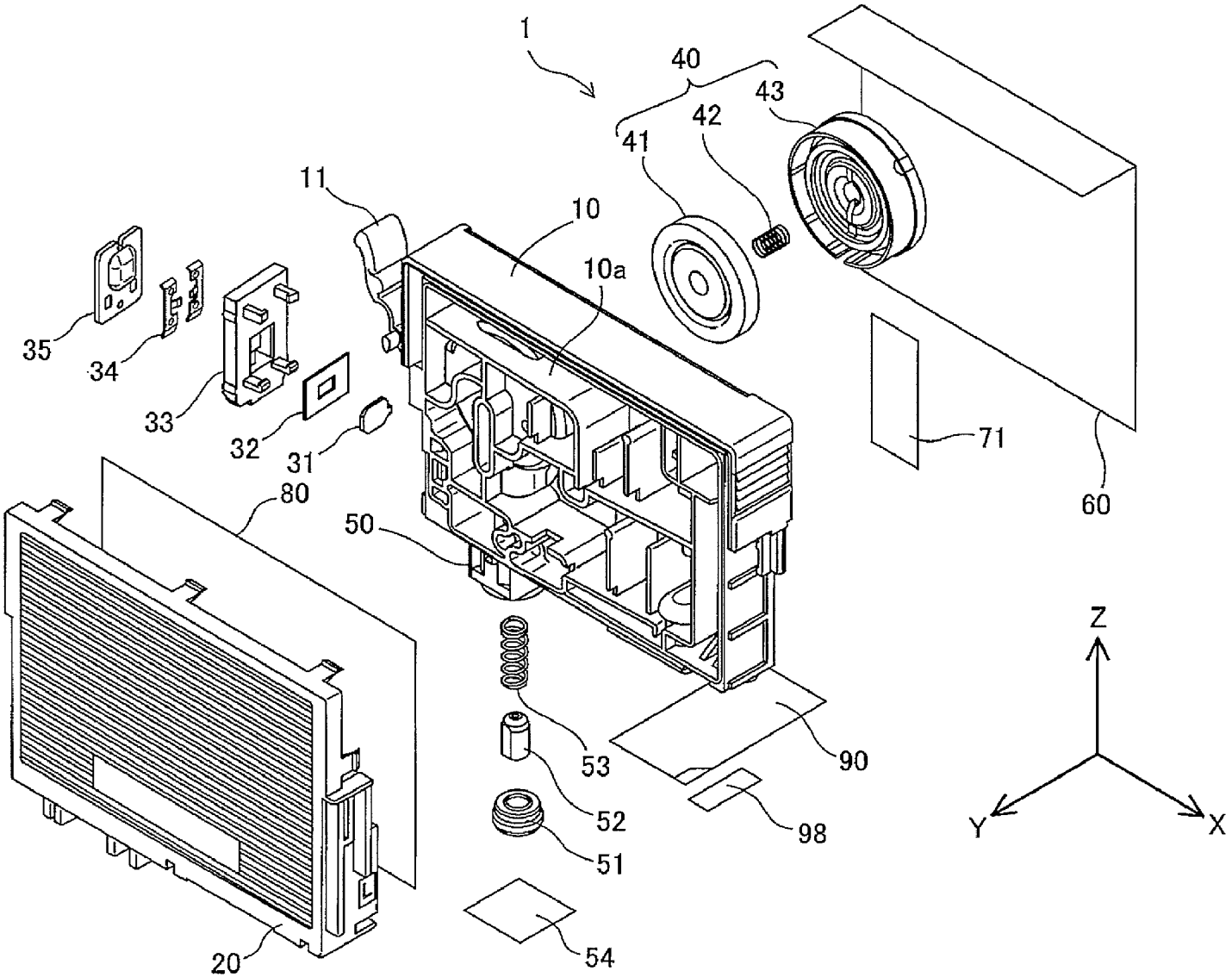
FIG. 3 is an exploded perspective view of the ink cartridge of the embodiment, seen from the direction of FIG. 1.
Figure 4:
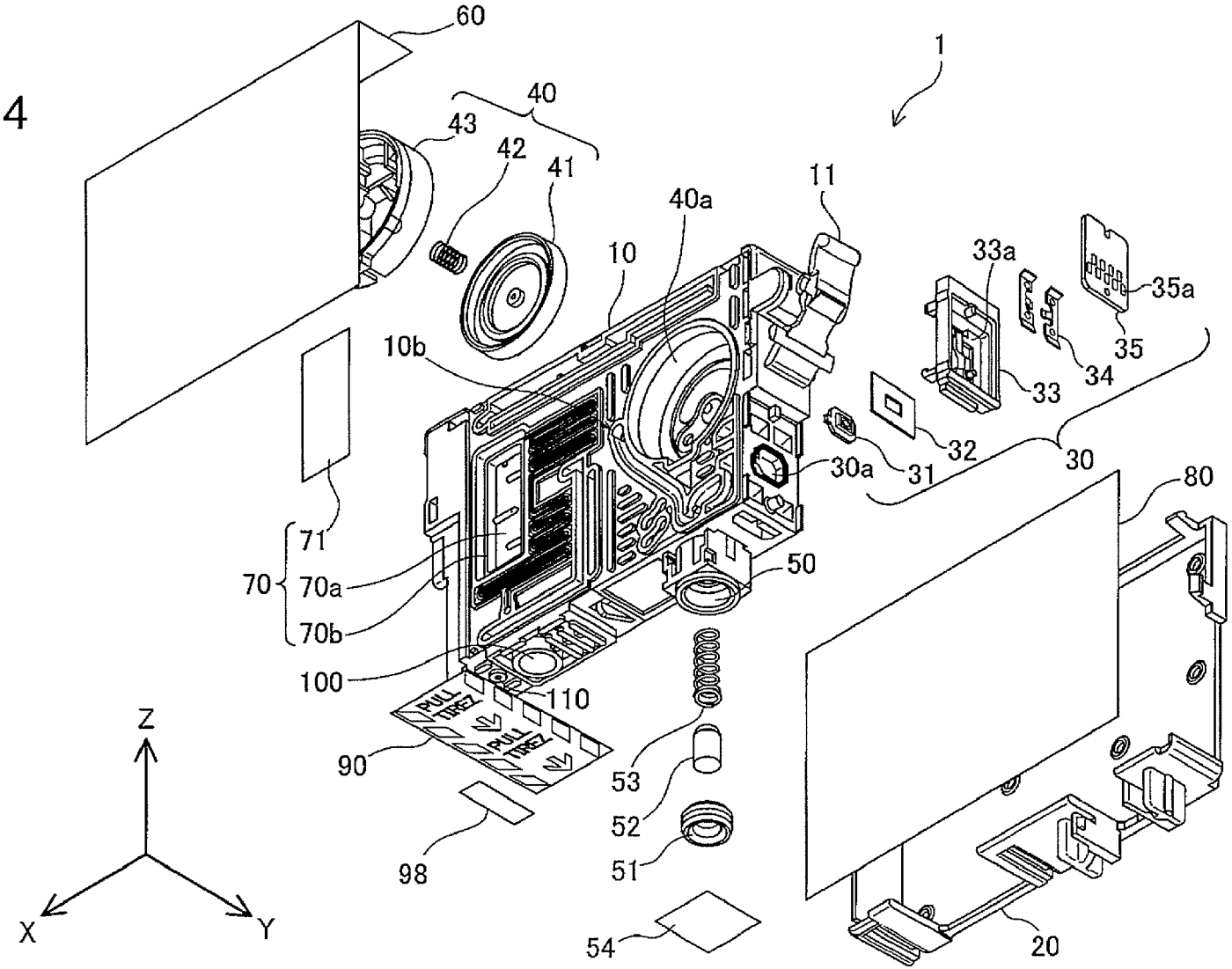
FIG. 4 is an exploded perspective view of the ink cartridge of the embodiment, seen from the direction of FIG. 2.
Figure 5:
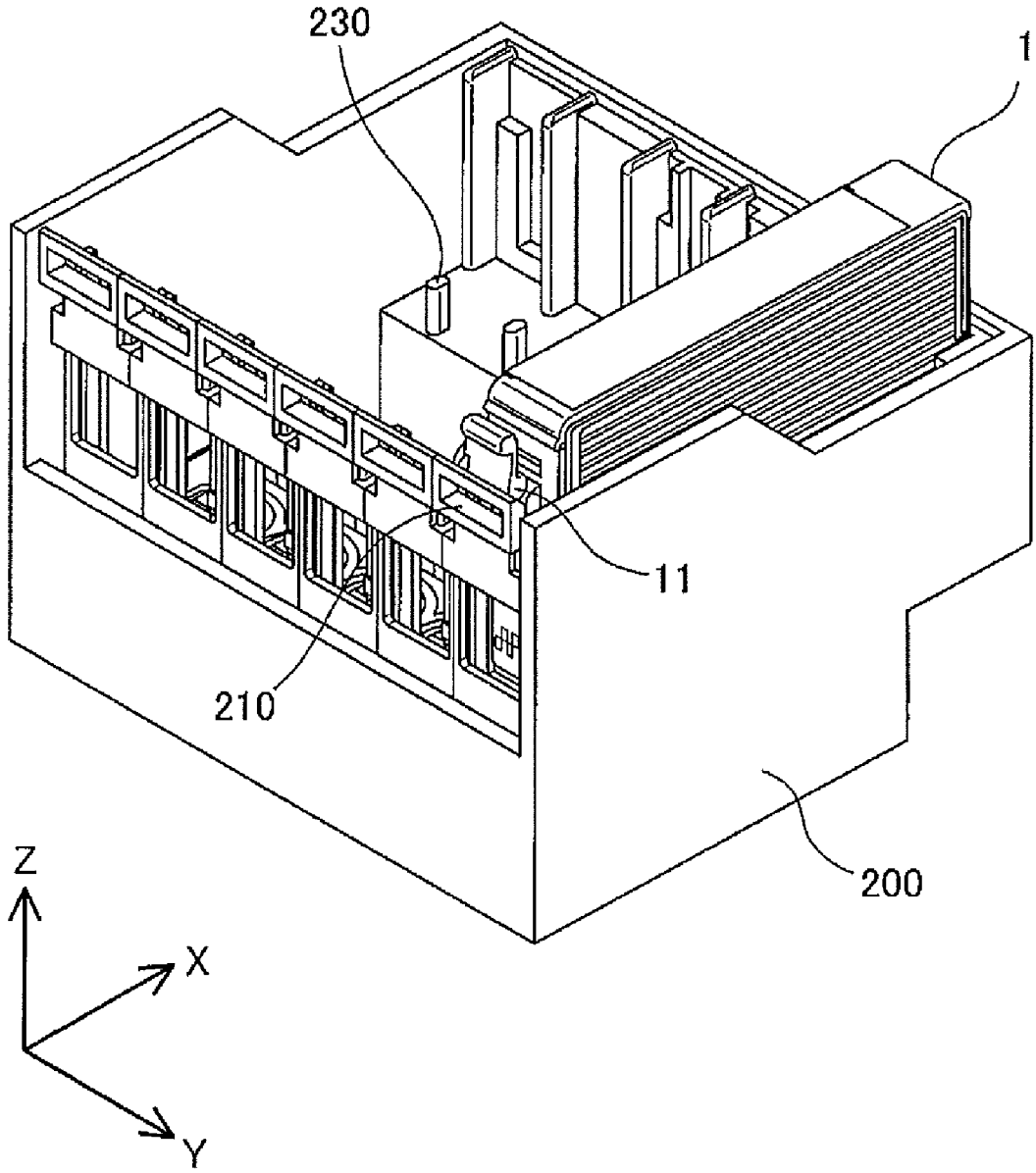
FIG. 5 is a perspective view showing the ink cartridge of the embodiment attached to a carriage.

A. Structure of Ink Cartridge:

The embodiment of the invention is described below with reference to the accompanied drawings. FIG. 1 is a perspective view showing the appearance of an ink cartridge 1, which is used for an ink cartridge remanufacturing process in one embodiment of the invention, seen from one direction. FIG. 2 is a perspective view showing the appearance of the ink cartridge 1 of the embodiment, seen from another direction that is opposite to the direction of FIG. 1. FIG. 3 is an exploded perspective view of the ink cartridge 1 of the embodiment, seen from the direction of FIG. 1. FIG. 4 is an exploded perspective view of the ink cartridge of the embodiment, seen from the direction of FIG. 2. Namely the exploded perspective view of FIG. 4 is seen from the direction opposite to the direction of FIG. 3. FIG. 5 is a perspective view showing the ink cartridge 1 of the embodiment attached to a carriage 200. In FIGS. 1 through 5, XYZ axes are shown for specifying the direction of the ink cartridge 1.

The ink cartridge 1 is structured to store ink in the liquid form therein. As shown in FIG. 5, the ink cartridge 1 is attached to a carriage 200 of an ink-jet printer to supply the ink to the ink-jet printer.

As shown in FIGS. 1 and 2, the ink cartridge 1 is formed in a substantially rectangular parallelepiped and has a Z-axis positive direction face 1*a*, a Z-axis negative direction face 1*b*, an X-axis positive direction face 1*c*, an X-axis negative direction face 1*d*, a Y-axis positive direction face 1*e*, and a Y-axis negative direction face 1*f*. In the description hereafter, for the sake of simplicity, the faces 1*a*, 1*b*, 1*c*, 1*d*, 1*e*, and 1*f* may also be respectively referred to as the top face, the bottom face, the right lateral face, the left lateral face, the front face, and the rear face. The sides corresponding to the faces 1*a*, 1*b*, 1*c*, 1*d*, 1*e*, and 1*f* are respectively referred to as the top side, the bottom side, the right side, the left side, the front side, and the rear side.

A liquid feeder 50 (corresponding to the liquid feeder in the claims of the invention) is provided on the bottom face 1*b* and has a feed hole for supplying the ink to the ink-jet printer. An air hole 100 open to the air is also formed in the bottom face 1*b* to introduce the air into the ink cartridge 1 (see FIG. 4).

The air hole 100 has a specific depth and a specific diameter sufficient to receive one of projections 230 (see FIG. 5), which are provided on the carriage 200 of the ink-jet printer, therein via a predetermined clearance. The user peels off a sealing film 90 that seals the air hole 100 in an air-tight manner and attaches the ink cartridge 1 to the carriage 200. The projections 230 are provided to prevent the user from forgetting to peel off the sealing film 90.

As shown in FIGS. 1 and 2, a catch lever 11 is provided on the left lateral face 1*d*. The catch lever 11 has a projection 11*a*. In attachment of the ink cartridge 1 to the carriage 200, the projection 11*a* is caught in a recess 210 formed in the carriage 200. The ink cartridge 1 is accordingly fastened to the carriage 200 (see FIG. 5). As clearly understood from this explanation, the carriage 200 functions as an attachment structure where the ink cartridge 1 is attached. In a printing process of the ink-jet printer, the carriage 200 moves integrally with a print head (not shown) back and forth along a width direction of a printing medium (main scanning direction). The main scanning direction represents the Y-axis direction in FIG. 5.

A circuit board 35 is provided below the catch lever 11 on the left lateral face Id (see FIG. 2). The circuit board 35 has multiple electrode terminals 35*a*, which are electrically connected with the ink-jet printer via corresponding electrode terminals (not shown) on the carriage 200.

An outer surface film 60 is applied on the top face 1*a* and on the rear face 1*f* of the ink cartridge 1.

Referring to FIGS. 3 and 4, the internal structure and the respective component structures of the ink cartridge 1 are explained in detail. The ink cartridge 1 has a cartridge body 10 and a cover member 20 designed to cover over the front side (the side of the face 1*e*) of the cartridge body 10.

Ribs 10*a* in various shapes are formed on the front side of the cartridge body 10 (see FIG. 3). A film 80 is provided between the cartridge body 10 and the cover member 20 to cover the front side of the cartridge body 10. The film 80 is closely applied onto the cartridge body 10 such as to make no spaces from the respective front ends of the ribs 10*a* a on the cartridge body 10. The ribs 10*a* a and the film 80 define multiple small chambers including an end chamber and a buffer chamber discussed later inside the ink cartridge 1.

A differential pressure regulator chamber 40*a* and a gas liquid separation chamber 70*a* are formed on the rear side of the cartridge body 10 (see FIG. 4). The differential pressure regulator chamber 40*a* receives a differential pressure regulator 40 including a valve member 41, a spring 42, and a spring washer 43. The gas liquid separation chamber 70*a* has a step 70*b* formed around an inner wall surrounding a bottom face. A gas liquid separating film 71 is attached to the step 70*b*. The gas liquid separating film 71 in combination with the gas liquid separation chamber 70*a* and the step 70*b* forms a gas liquid separation filter 70.

Multiple grooves 10*a* b are formed on the rear side of the cartridge body 10 (see FIG. 4). In application of the outer surface film 60 to cover over the substantially whole rear face of the cartridge body 10, these multiple grooves 10*a* b form various flow paths (discussed later), for example, flow paths for ink and the air, between the cartridge body 10 and the outer surface film 60.

The peripheral structure of the circuit board 35 is described. A sensor chamber 30*a* (corresponding to the sensor unit in the claims of the invention) is formed in a lower area (on the side of the face 1*b*) of the right lateral face (the face 1*c*) of the cartridge body 10. A liquid level sensor 31 is placed in the sensor chamber 30*a* and is stuck by a film 32. The opening of the sensor chamber 30*a* on the right lateral face is covered with a sensor cover 33. The circuit board 35 is fixed to an outer surface 33*a* of the sensor cover 33 via a trunk terminal 34. The liquid level sensor 31 in combination with the sensor chamber 30a, the film 32, the sensor cover 33, the trunk terminal 34, and the circuit board 35 constitutes a sensor unit 30.

The liquid level sensor 31 has a cavity arranged to form part of an ink fluid assembly (discussed later), a diaphragm arranged to form part of wall surface of the cavity, and a piezoelectric element located on the diaphragm. The detailed structure of the liquid level sensor 31 is not specifically illustrated. A terminal of the piezoelectric element is electrically connected with part of the electrode terminals 35*a* on the circuit board 35. In attachment of the ink cartridge 1 to the ink-jet printer, the terminal of the piezoelectric element is electrically connected with the ink-jet printer via the electrode terminal 35*a* of the circuit board 35. The ink-jet printer gives electrical energy to the piezoelectric element to vibrate the diaphragm via the piezoelectric element. The ink-jet printer detects the residual vibration characteristic (for example, the frequency) of the diaphragm via the piezoelectric element, so as to identify the presence or the absence of ink in the cavity. Consumption of the ink stored in the cartridge body 10 changes the internal state of the cavity from the ink filling state to the air filling state. This leads to a change of the residual vibration characteristic of the diaphragm. The change of the residual vibration characteristic is detected by the liquid level sensor 31. Based on the result of such detection, the ink-jet printer identifies the presence or the absence of the ink in the cavity and thereby detects the consumed state or the remaining state of ink in the ink cartridge 1.

The circuit board 35 has a rewritable non-volatile memory, such as an EEPROM (electronically erasable and programmable read only memory), to record the consumed amount of ink by the ink-jet printer or other pieces of relevant information.

A decompression hole 110 is provided, together with the liquid feeder 50 and the air hole 100 mentioned above, on the bottom face of the cartridge body 10 (see FIG. 4). The decompression hole 110 is used to suck out the air and depressurize the inside of the ink cartridge 1 at an ink filling step in a remanufacturing process of the ink cartridge 1.

Immediately after manufacture of the ink cartridge 1, the openings of the liquid feeder 50, the air hole 100, and the decompression hole 110 are respectively sealed with sealing films 54, 90, and 98. The sealing film 90 is peeled off by the user, prior to attachment of the ink cartridge 1 to the carriage 200 of the ink-jet printer as explained previously. The peel-off of the sealing film 90 makes the air hole 100 communicate with the outside air to allow introduction of the air into the ink cartridge 1. In the state of attachment of the ink cartridge 1 to the carriage 200 of the ink-jet printer, the sealing film 54 is broken by an ink supply needle 240 (see FIG. 6) provided on the carriage 200.

A closing spring 53, a spring washer 52, and a seal member 51 are provided inside the liquid feeder 50 to be arranged in this order from the inside to the outside (see FIG. 4). In insertion of the ink supply needle 240 into the liquid feeder 50, the seal member 51 seals the liquid feeder 50 to make no clearance between the inner wall of the liquid feeder 50 and the outer wall of the ink supply needle 240. In the state of no attachment of the ink cartridge 1 to the carriage 200, the spring washer 52 comes into contact with the inner wall of the seal member 51 to close the liquid feeder 50. The closing spring 53 presses the spring washer 52 in a specific direction to bring the spring washer 52 into contact with the inner wall of the seal member 51. In insertion of the ink supply needle 240 on the carriage 200 into the liquid feeder 50, an upper edge of the ink supply needle 240 presses up the spring washer 52 to make a clearance between the spring washer 52 and the seal member 51. A supply of ink is fed to the ink supply needle 240 through this clearance.

Prior to the detailed explanation of the internal structure of the ink cartridge 1, for the better understanding, the pathway from the air hole 100 to the liquid feeder 50 is conceptually discussed with reference to FIG. 6.

The pathway from the air hole 100 to the liquid feeder 50 is roughly divided into an ink reservoir assembly for storage of ink, an air introduction assembly provided in the upstream of the ink reservoir assembly, and an ink fluid assembly provided in the downstream of the ink reservoir assembly.

The air introduction assembly has the air hole 100, a serpentine path 310, the gas liquid separation chamber 70*a* provided to receive the gas liquid separating film 71 therein as discussed above, and air chambers 320 to 360 formed to connect the gas liquid separation chamber 70*a* to the ink reservoir assembly, which are arranged in this order from the upstream to the downstream. The serpentine path 310 has an upstream end connecting with the air hole 100 and a downstream end connecting with the gas liquid separation chamber 70*a*. The serpentine path 310 meanders to extend the length from the air hole 100 to the ink reservoir assembly. This arrangement desirably prevents vaporization of the water content in the ink in the ink reservoir assembly. The gas liquid separating film 71 is made of a specific material that allows transmission of gas but prohibits transmission of liquid. The gas liquid separating film 71 is provided between an upstream section and a downstream section of the gas liquid separation chamber 70*a*. This arrangement aims to prevent the backflow of the ink from the ink reservoir assembly from flowing into the upstream of the gas liquid separation chamber 70*a*. The concrete structure of the air chambers 320 to 360 will be described later.

The ink reservoir assembly has a tank chamber 370, a communicating path 380, and an end chamber 390, which are arranged in this order from the upstream to the downstream. The communicating path 380 has an upstream end connecting with the tank chamber 370 and a downstream end connecting with the end chamber 390. Instead of the separate tank chamber 370 and end chamber 390, the tank chamber 370 may be integrated with the end chamber 390. The tank chamber 370 and the end chamber 390 respectively correspond to the first chamber and the second chamber in the claims of the invention.

The ink fluid assembly has a bubble trap flow path 400, a bubble trap chamber 410, a first fluid path 420, the sensor unit 30 mentioned above, a second fluid path 430, a buffer chamber 440, the differential pressure regulator chamber 40*a* provided to receive the differential pressure regulator 40 therein as discussed above, a third fluid path 450, and a fourth fluid path 460, which are arranged in this order from the upstream to the downstream. The bubble trap flow path 400 and the bubble trap chamber 410 respectively correspond to the bubble trap flow path and the bubble trap chamber in the claims of the invention.

Figure 7:
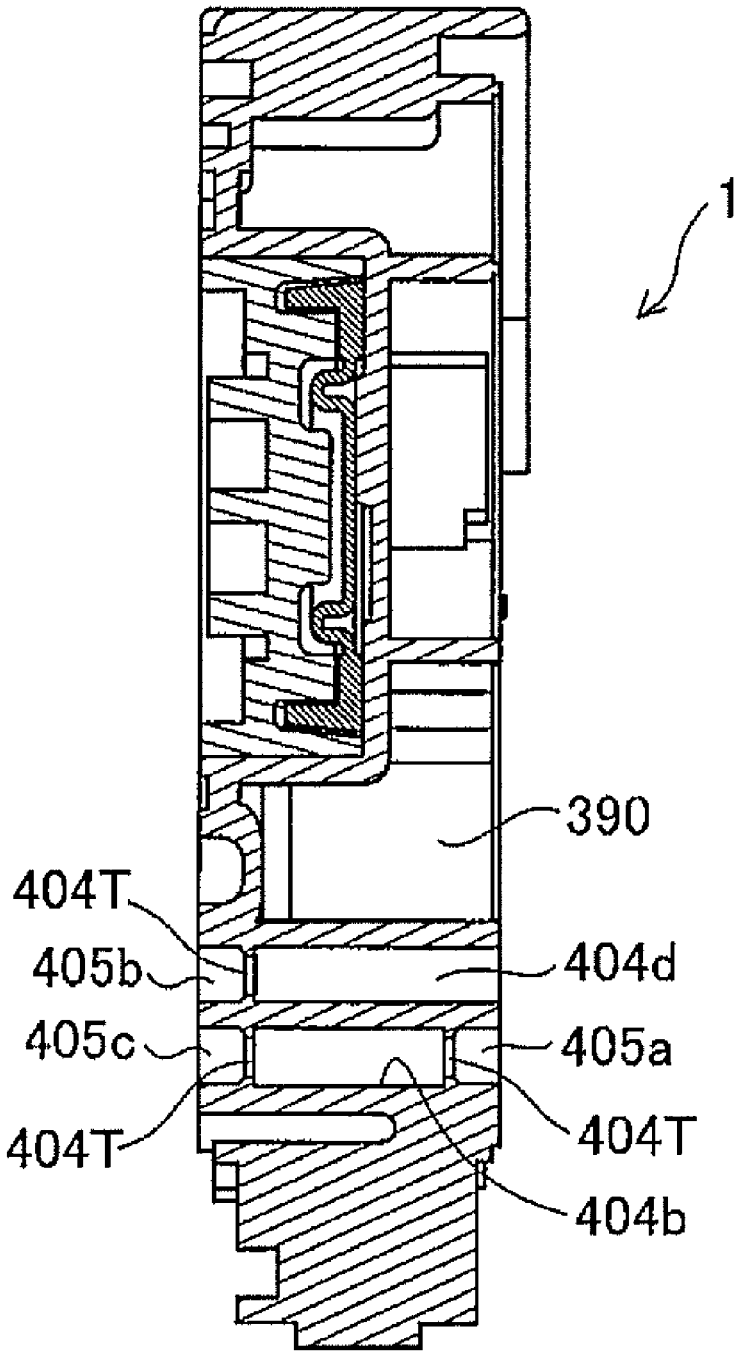
FIG. 7 is a sectional view of the ink cartridge, taken on a line 7-7 in FIG. 11.
Figure 8:
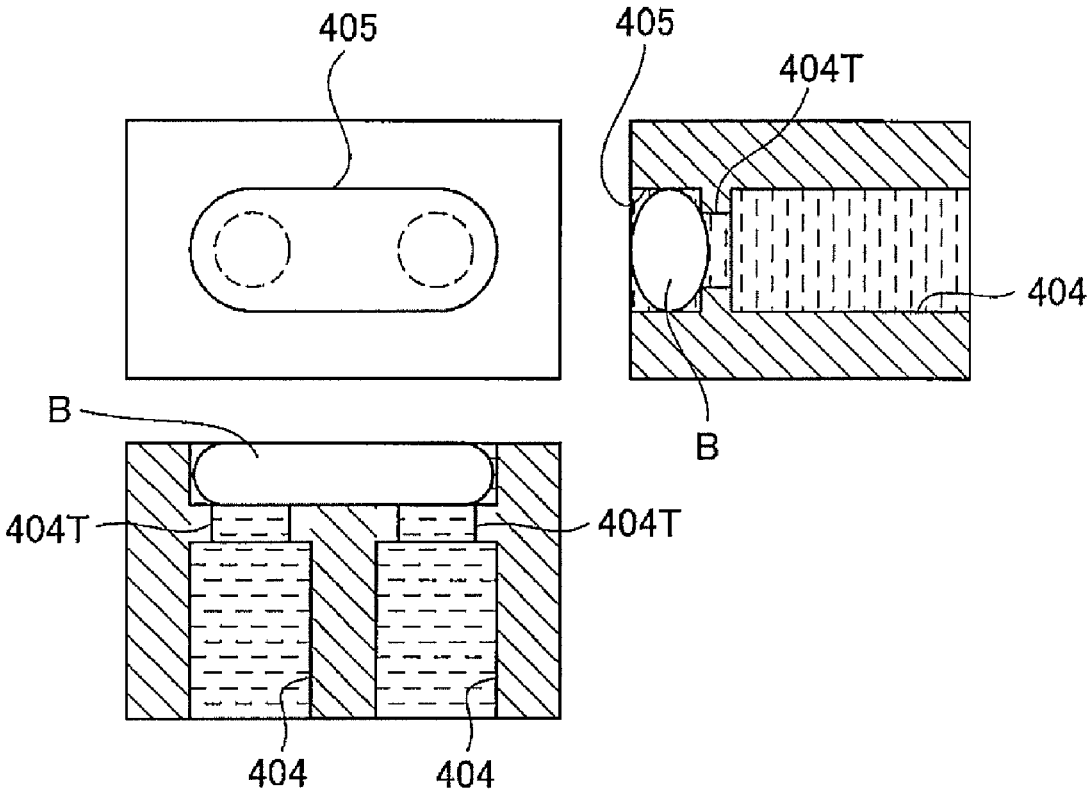
FIG. 8 is explanatory views showing the characteristics of a bubble trap flow path in the embodiment.
Figure 9:
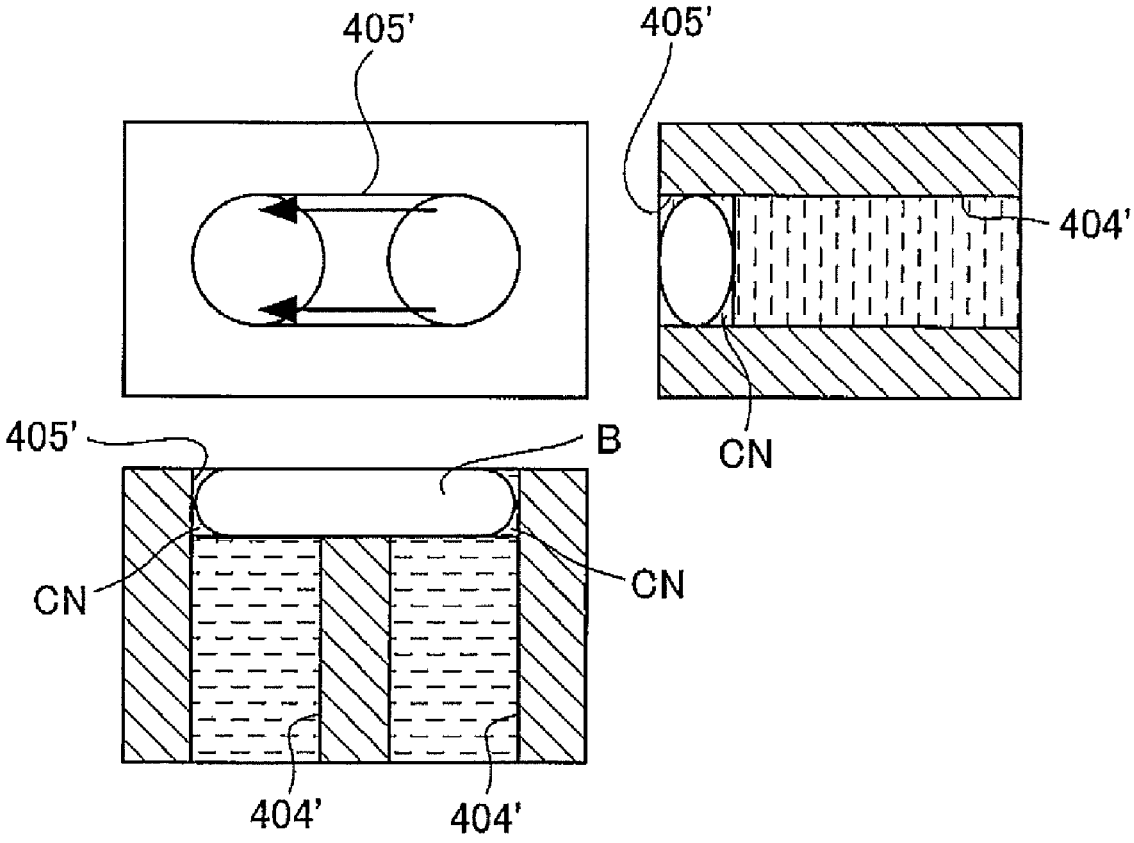
FIG. 9 is explanatory views showing the structure of a comparative example to explain the characteristics of the bubble trap flow path in the embodiment.
Figure 10:
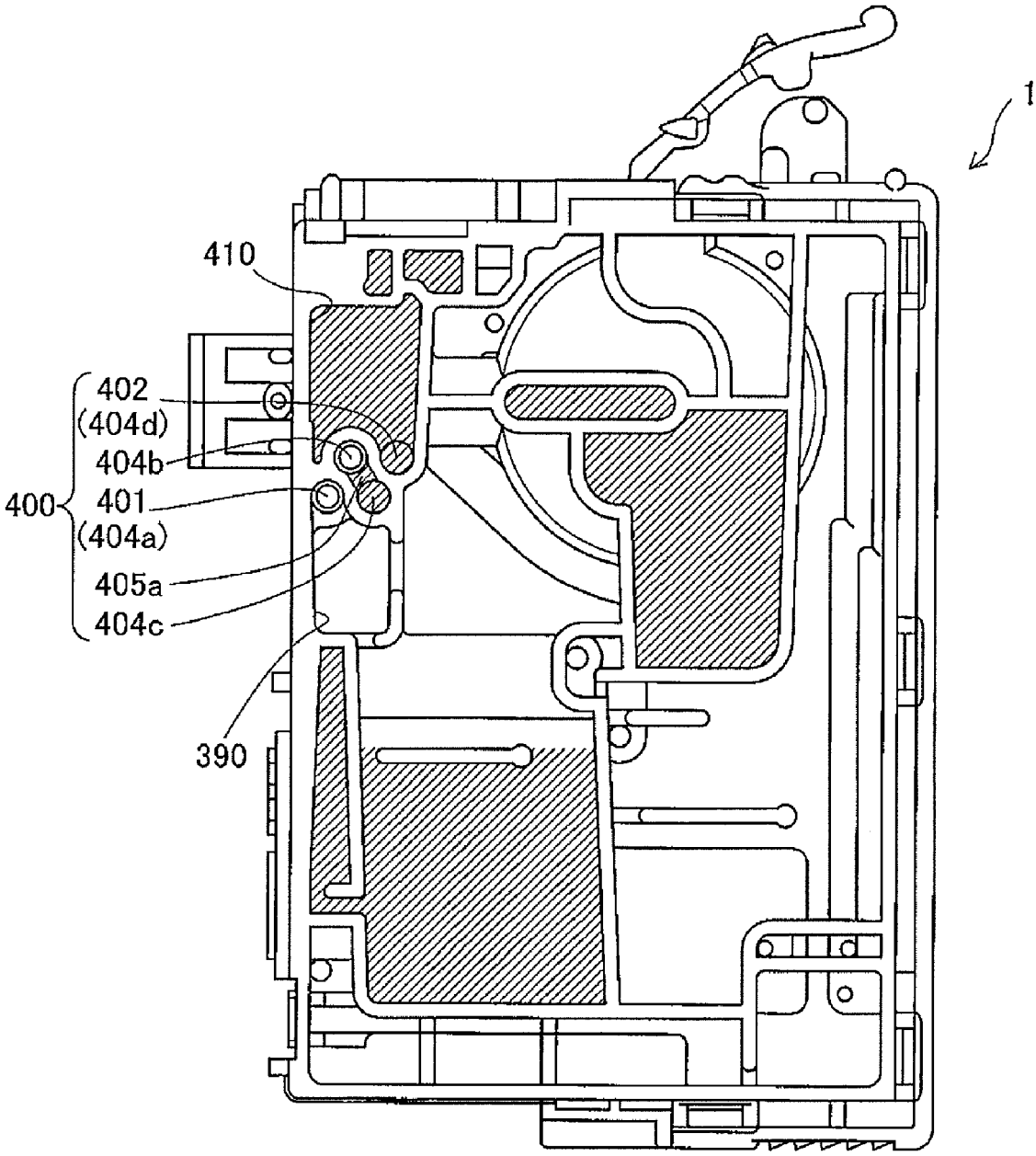
FIG. 10 is an explanatory view showing the characteristics of the bubble trap flow path related to the attitude of the ink cartridge in the embodiment.

The bubble trap flow path 400 has sterically-arranged multiple bends and is formed like dog-leg stairs. The detailed structure of the bubble trap flow path 400 is described with reference to FIGS. 7 through 10. FIG. 7 is a sectional view of the ink cartridge 1, taken on a line 7-7 in FIG. 11 explained later. FIG. 8 is explanatory views showing the characteristics of the bubble trap flow path 400 in the embodiment. FIG. 9 is explanatory views showing the structure of a comparative example to explain the characteristics of the bubble trap flow path 400 in the embodiment. FIG. 10 is an explanatory view showing the characteristics of the bubble trap flow path 400 related to the attitude of the ink cartridge 1 in the embodiment.

The bubble trap flow path 400 has four cylindrical flow paths 404, a first cylindrical flow path 404a to a fourth cylindrical flow path 404*d*, and three connecting flow paths 405, a first connecting flow path 405*a* to a third connecting flow path 405*c*. The respective cylindrical flow paths 404*a* to 404*d* are formed perpendicular to the vertical direction (see FIG. 8) and are arranged in zigzag in the vertical direction (see FIG. 11). The four cylindrical flow paths 404*a* to 404*d* are formed in parallel with the bottom face of the ink cartridge 1 to be extended in a depth direction (Y direction) and are arranged at different heights in the vertical direction (height direction). In the structure of this embodiment, the four cylindrical flow paths 404*a* to 404*d* are divided into two groups overlapping in the vertical direction. The first group includes the first cylindrical flow path 404*a* and the third cylindrical flow path 404*c*. The second group includes the second cylindrical flow path 404*b* and the fourth cylindrical flow path 404*d*. The heights of the first cylindrical flow path 404*a* to the fourth cylindrical flow path 404*d* in the vertical direction gradually increase in this sequence.

Each of the connecting flow paths 405 is extended obliquely upward and interconnects the two cylindrical flow paths 404 on both the lateral faces of the ink cartridge 1, so as to form the bubble trap flow path 400 as one integral communicating path from an inlet 401 to an outlet 402. On the lateral face of the ink cartridge 1 with the two connecting flow paths 405 arranged thereon, the two connecting flow paths 405 respectively connecting the two cylindrical flow paths 404 are arranged in parallel to each other. On the first lateral face (the side shown in FIG. 11), one end of the second cylindrical flow path 404*b* is connected with one end of the third cylindrical flow path 404*c* by the first connecting flow path 405*a*. On the second lateral face (the side shown in FIG. 12), the other end of the first cylindrical flow path 404*a* is connected with the other end of the second cylindrical flow path 404*b* by the second connecting flow path 405*b*. The other end of the third cylindrical flow path 404*c* is connected with the other end of the fourth cylindrical flow path 404*d* by the third connecting flow path 405*c*. This forms the bubble trap flow path 400 in a dog-leg stair shape (or in a spiral shape) from the inlet 401 toward the outlet 402. The first connecting flow path 405*a* to the third connecting flow path 405*c* in combination with the outer surface film 60 and the film 80 define flow passages. The first connecting flow path 405*a* to the third connecting flow path 405*c* are thus also called first through third connecting flow path-forming elements. Each of the first connecting flow path 405*a* to the third connecting flow path 405*c* is preferably formed to have a semicircular cross section or a curved cross section without any edge. The bubbles entering the flow path tend to conglobate by means of the surface tension. The presence of the edge, however, causes clearances between the edge and the curvature of bubbles, which interfere with effective ink sealing. The edge-free structure of the connecting flow path 405 causes the bubbles to follow the shape of the flow path and forms no clearances between the bubbles and the connecting flow paths, thus effectively preventing the downstream-to-upstream flow of ink with the bubbles remaining in the flow path.

The structure of the bubble trap flow path 400 discussed above effectively prevents migration of bubbles into the bubble trap chamber 410, which is caused by a change of the external environment, for example, a variation of the ambient temperature or a variation of the outside atmospheric pressure. For example, in an ink-freezing environment at decreased ambient temperature, the ink filled in the bubble trap chamber 410 increases its volume and flows into the end chamber 390. The ink decreases its volume to the original level when being unfrozen. The ink may be unfrozen in the state where an inlet of the bubble trap chamber 410 is in contact with the air in the end chamber 390 according to the attitude of the ink cartridge 1. In this state, the air in the end chamber 390 may flow into the bubble trap chamber 410 to form bubbles in the bubble trap chamber 410. In the structure of the embodiment, the bubble trap flow path 400 is designed to have a greater volume than the increased volume of frozen ink filled in a space between the bubble trap chamber 410 and the buffer chamber 440. This arrangement effectively makes the unfrozen ink remain in the bubble trap flow path 400 and thereby controls or prevents migration of the air (bubbles) into the bubbler trap chamber 410. The buffer chamber 440 is also designed by taking into account the potential volume increase of frozen ink.

In the structure of the embodiment, each of the cylindrical flow paths 404 has a constriction 404T having a smaller diameter than the flow path diameters of the residual part of the cylindrical flow path 404 and the connecting flow path 405 at each end connecting with the connecting flow path 405 as shown in FIGS. 7 and 8. The constriction 404T prevents or reduces the ink flow from the connecting flow path 405 to the cylindrical flow path 404. The flow path diameter of the residual part of the cylindrical flow path 404 may be identical with or may be smaller than (or greater than) the flow path diameter of the connecting flow path 405.

In the structure of a cylindrical flow path without any constriction shown as a comparative example in FIG. 9, in the presence of a bubble B in a connecting flow path 405', a cylindrical flow path 404' communicates with the connecting flow path 405' via a clearance CN formed between the curvature of the bubble B and the connecting flow path 405'. Such communication allows ink to flow between the end chamber 390 and the bubble trap chamber 410 across the clearance CN. The ink flows out toward the end chamber 390 under application of a pressure from the downstream (that is, from the side of the bubble trap chamber 410). The bubble B does not move during the ink flow across the clearance CN and is gradually accumulated with other bubbles B moving from the upstream to the downstream. The bubbles accordingly tend to accumulate in the bubble trap flow path 400.

In the structure of the cylindrical flow path 404 with the constriction 404T shown in FIG. 8, on the other hand, the constriction 404T has the smaller diameter than the flow path diameters of the residual part of the cylindrical flow path 404 and the connecting flow path 405. A bubble B entering the connecting flow path 405 accordingly has the greater diameter than the diameter of the constriction 404T of the cylindrical flow path 404. The constriction 404T interferes with communication of clearances formed between the curvature of the bubble B and the connecting flow path 405 with the cylindrical flow path 404. The cylindrical flow path 404 is accordingly sealed by the bubble B. The bubble B flowing into the connecting flow path 405 is pressed against the upstream cylindrical flow path 404 under application of a pressure from the downstream. The cylindrical flow path 404 (with the constriction 404T) is thus sealed with the bubble B. This arrangement does not allow ink to be flowed between the end chamber 390 and the bubble trap chamber 410 and thereby controls or prevents the outflow of ink to the end chamber 390.

The bubble trap flow path 400 is structured such as to allow migration of bubbles into the bubble trap chamber 410 only in the event of moving the bubbles in the direction of gravity at any attitude of the ink cartridge 1 other than the normal attitude in attachment to the ink-jet printer or other than the attitude with the bottom face 1*b* of the ink cartridge 1 facing down as shown in FIG. 10.

In the bubble trap flow path 400, the first connecting flow path 405*a* and the third connecting flow path 405*c* are arranged in a V shape at the attitude of the ink cartridge 1 shown in FIG. 10. In general, the bubble trap flow path 400 has at least a connecting flow path A extended obliquely downward (in a first direction) relative to the vertical direction from the bubble trap chamber 410 and a connecting flow path B arranged to connect with the connecting flow path A and extended obliquely downward (in a second direction) that is axisymmetric with the connecting flow path A.

The structure of the bubble trap flow path 400 effectively controls or prevents migration (flow) of bubbles into the bubble trap chamber 410 at any attitude of the ink cartridge 1 detached from the ink-jet printer. At the attitude of the ink cartridge 1 attached to the ink-jet printer, the inlet 401 of the bubble trap flow path 400 located at the lower-most position of the end chamber 390 is not exposed to the air. No bubble accordingly flows through the bubble trap flow path 400. At any other attitude of the ink cartridge 1, the bubble trap flow path 400 is designed to allow migration of bubbles into the bubble trap chamber 410 only in the event of moving bubbles in the direction of gravity. This actually interferes with migration of bubbles. The structure of the bubble trap flow path 400 thus effectively controls or prevents migration of bubbles from the bubble trap flow path 400 into the bubble trap chamber 410 at any attitude of the ink cartridge 1. The bubble trap flow path 400 of this structure has the greater flow resistance than those of the other ink flow paths.

The bubble trap chamber 410 communicates with the first fluid path 420 via a communication hole 412 formed in the bubble trap chamber 410. The first fluid path 420 has a downstream end connecting with the sensor unit 30. The bubble trap chamber 410 separates bubbles included in the ink flowed in from the bubble trap flow path 400 and thereby controls or prevents migration of bubbles into the sensor unit 30. The bubble trap chamber 410 is designed to allow the inflow of ink via the outlet 402 from the bubble trap flow path 400 located above the bubble trap chamber 410 (in a Z direction) and the outflow of ink via the second fluid path 430 located below the bubble trap chamber 410 toward the sensor unit 30. This structure of the bubble trap chamber 410 causes the bubble (air)-incorporated ink flowed in from the bubble trap flow path 400 to be separated into a gas component (the air content in the ink) remaining in the upper portion of the bubble trap chamber 410 and a liquid component (ink) moving down along the inner wall surface of the bubble trap chamber 410 to the lower portion of the bubble trap chamber 410. The bubbles are trapped in the upper portion of the bubble trap chamber 410 by utilizing the difference of the specific gravity between the gas component and the liquid component. The bubbles are naturally not formed in the absence of either the air or the ink. Separation of the air from the ink thus effectively controls or prevents migration of bubbles into the sensor unit 30 and thereby decreases or substantially eliminates the potential for false detection by the liquid level sensor 31. The bubbles migrated into the sensor unit 30 may cause the liquid level sensor 31 to falsely detect the out-of-ink although the ink actually remains in the ink cartridge 1. When substantially no ink remains in the ink cartridge 1, suction of a very little amount of remaining ink with the air as a bubble-incorporated liquid into the sensor unit 30 by the capillarity may cause the liquid level sensor 31 to falsely detect the presence of the ink. In the former case, the ink-jet printer does not perform printing irrespective of the presence of ink in the ink cartridge 1. In the latter case, the ink-jet printer performs printing irrespective of the absence of ink in the ink cartridge 1. This may damage a print head.

The second fluid path 430 has an upstream end connecting with the sensor unit 30 and a downstream end connecting with the buffer chamber 440. The buffer chamber 440 directly communicates with the differential pressure regulator chamber 40*a* including the differential pressure regulator 40. With supply of ink from the liquid feeder 50 to the ink-jet printer as the liquid consuming device, the ink in the downstream of the differential pressure regulator 40 has a negative pressure. During the time period when the negative pressure of the ink exceeds the closing force of the differential pressure regulator 40, the differential pressure regulator 40 is opened to make the ink flow from the upstream to the downstream of the differential pressure regulator 40. Namely the differential pressure regulator 40 is designed to allow a unidirectional flow of ink from the upstream to the downstream. When the ink in the downstream of the differential pressure regulator 40 has a positive pressure, for example, due to ink refill from the liquid feeder 50, a valve-closing force is applied to the differential pressure regulator 40 to prevent the backflow of ink from the downstream to the upstream of the differential pressure regulator 40. The third fluid path 450 has an upstream end connecting with the differential pressure regulator chamber 40*a* and a downstream end connecting with the liquid feeder 50 via the fourth fluid path 460.

In manufacture of the ink cartridge 1, ink is filled to the tank chamber 370. The liquid level of the ink in this state is conceptually shown as a broken line ML1 in FIG. 6. As the ink stored in the ink cartridge 1 is gradually consumed by the ink-jet printer, the liquid level of the ink moves in the downstream, while the air introduced through the air hole 100 flows from the upstream into the ink cartridge 1. With further consumption of ink, the liquid level of the ink reaches the sensor unit 30. The liquid level of the ink in this state is conceptually shown as a broken line ML2 in FIG. 6. The resulting introduction of the air into the sensor unit 30 is detected as the out-of-ink by the liquid level sensor 31. In response to detection of the out-of-ink, the ink-jet printer stops printing at a stage prior to complete consumption of he ink present in the downstream of the sensor unit 30 (for example, the buffer chamber 440) in the ink cartridge 1 and informs the user of the out-of-ink. This arrangement effectively prevents printing operations with the air present in the print head.

Figure 11:
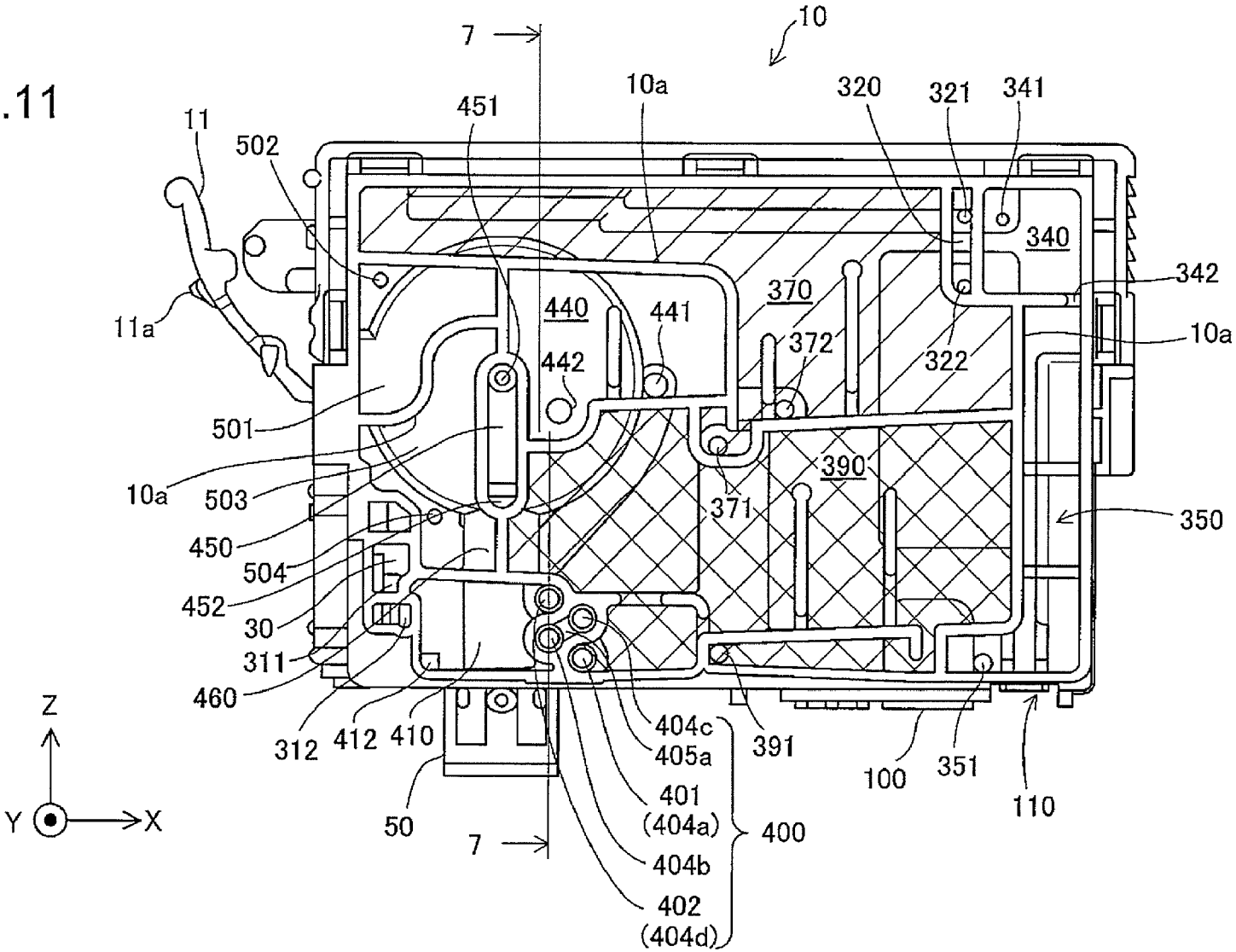
FIG. 11 is a front view showing a cartridge body in the ink cartridge of the embodiment.
Figure 12:
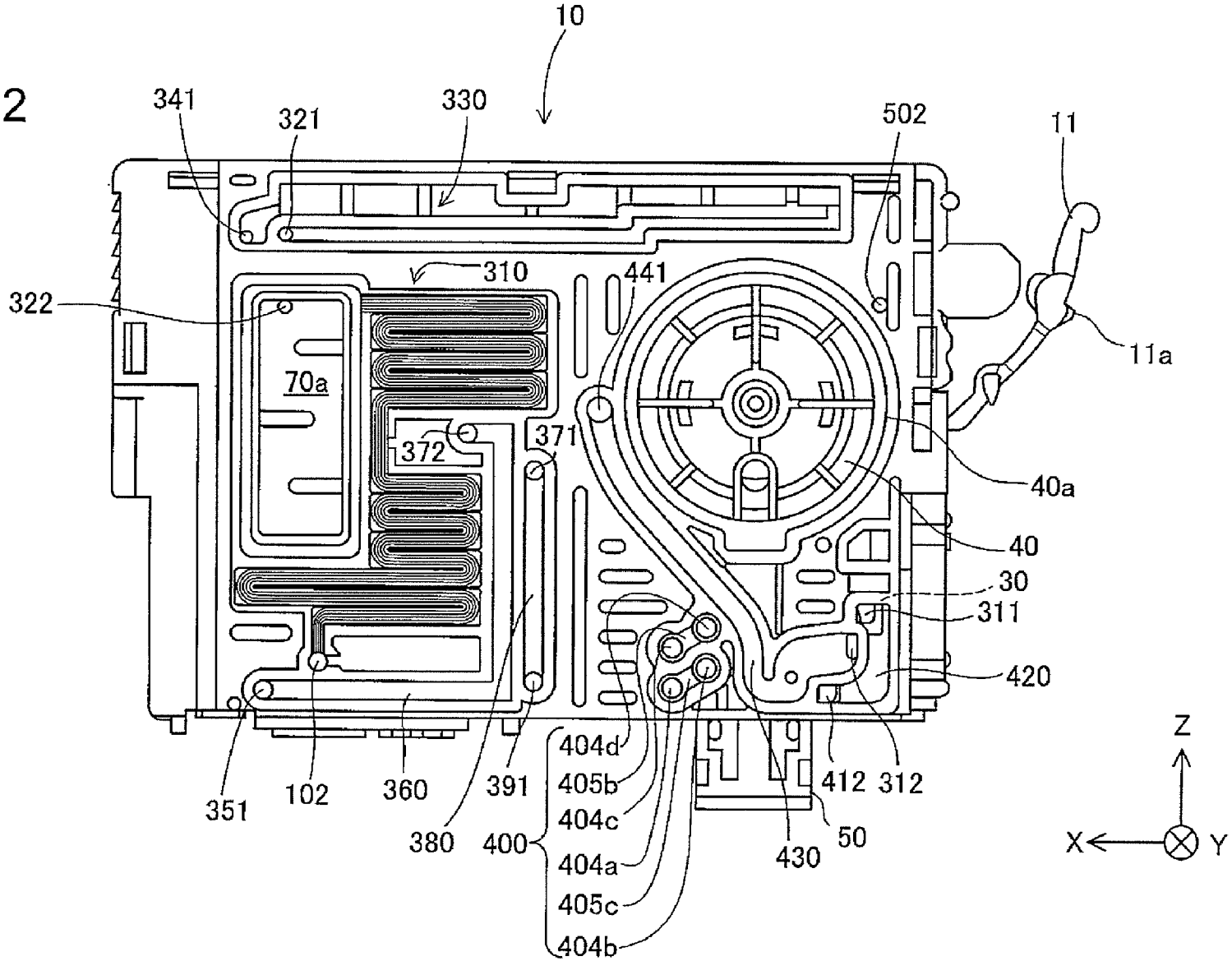
FIG. 12 is a rear view showing the cartridge body in the ink cartridge of the embodiment.
Figure 13A:
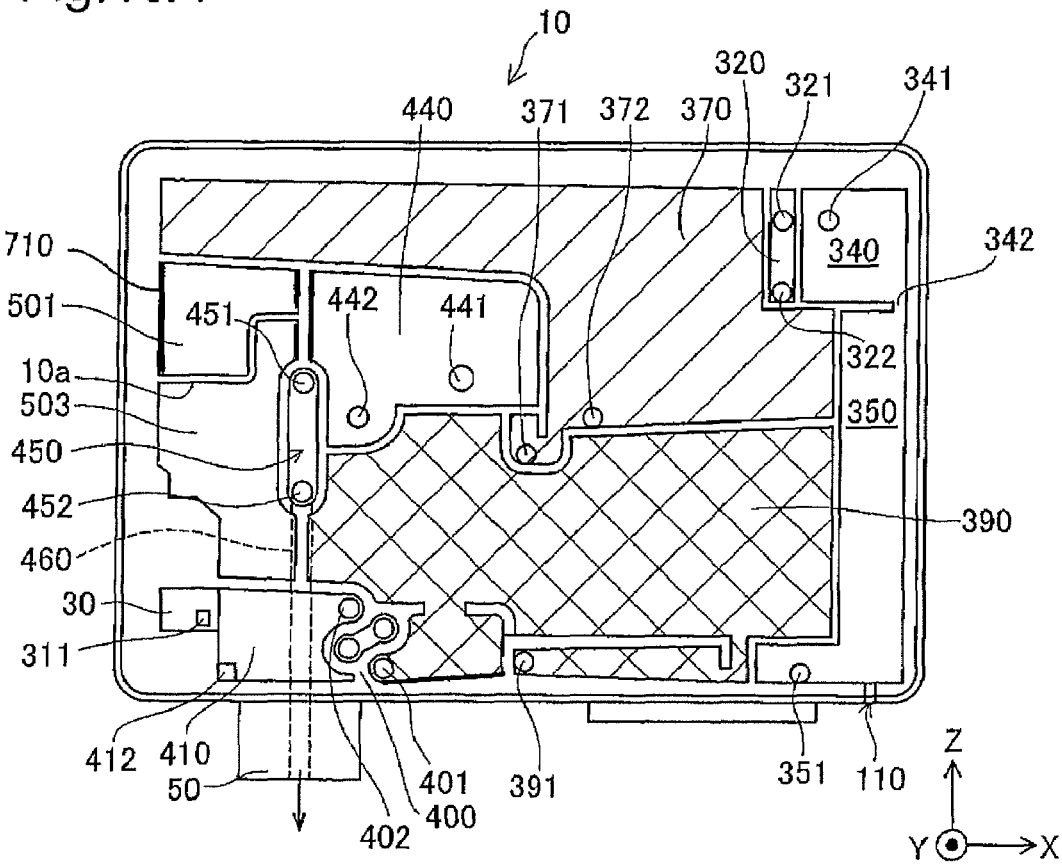
FIGS. 13A and 13B are simplified views respectively showing the structure of FIG. 11 and the structure of FIG. 12.

On the basis of the above discussion, the concrete structures of the respective components of the ink cartridge 1 in the pathway from the air hole 100 to the liquid feeder 50 are described with reference to FIGS. 11 through 13. FIG. 11 is a front view showing the cartridge body 10 of the ink cartridge 1. FIG. 12 is a rear view showing the cartridge body 10 of the ink cartridge 1. FIG. 13A is a simplified view showing the structure of FIG. 11, and FIG. 13B is a simplified view showing the structure of FIG. 12.

The tank chamber 370 and the end chamber 390 of the ink reservoir assembly are provided on the front face of the cartridge body 10. The tank chamber 370 and the end chamber 390 are shown as a single hatched area and a cross hatched area in FIGS. 11 and 13A. The inner wall of the end chamber 390 forms the bottom face of the cartridge body 10 in an area between the liquid feeder 50 and the air hole 100. The communicating path 380 is formed in a center portion on the rear face of the cartridge body 10 as shown in FIGS. 12 and 13B. A communication hole 371 is formed to connect the upstream end of the communicating path 380 with the tank chamber 370. A communication hole 391 is formed to connect the downstream end of the communicating path 380 with the end chamber 390.

Figure 13B:
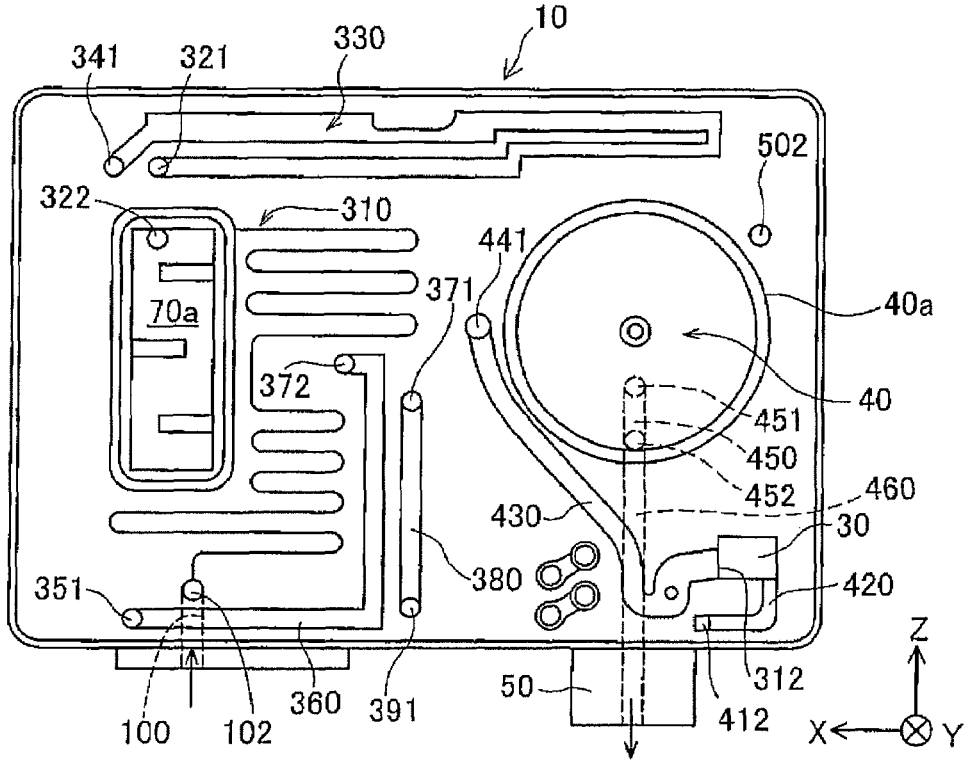

The serpentine path 310 and the gas liquid separation chamber 70*a* of the air introduction assembly are formed in a specific area close to the right side on the rear face of the cartridge body 10 as shown in FIGS. 12 and 13B. A communication hole 102 is formed to connect the upstream end of the serpentine path 310 with the air hole 100. The downstream end of the serpentine path 310 passes through the side wall of the gas liquid separation chamber 70*a* to communicate with the gas liquid separation chamber 70*a*.

Figure 6:
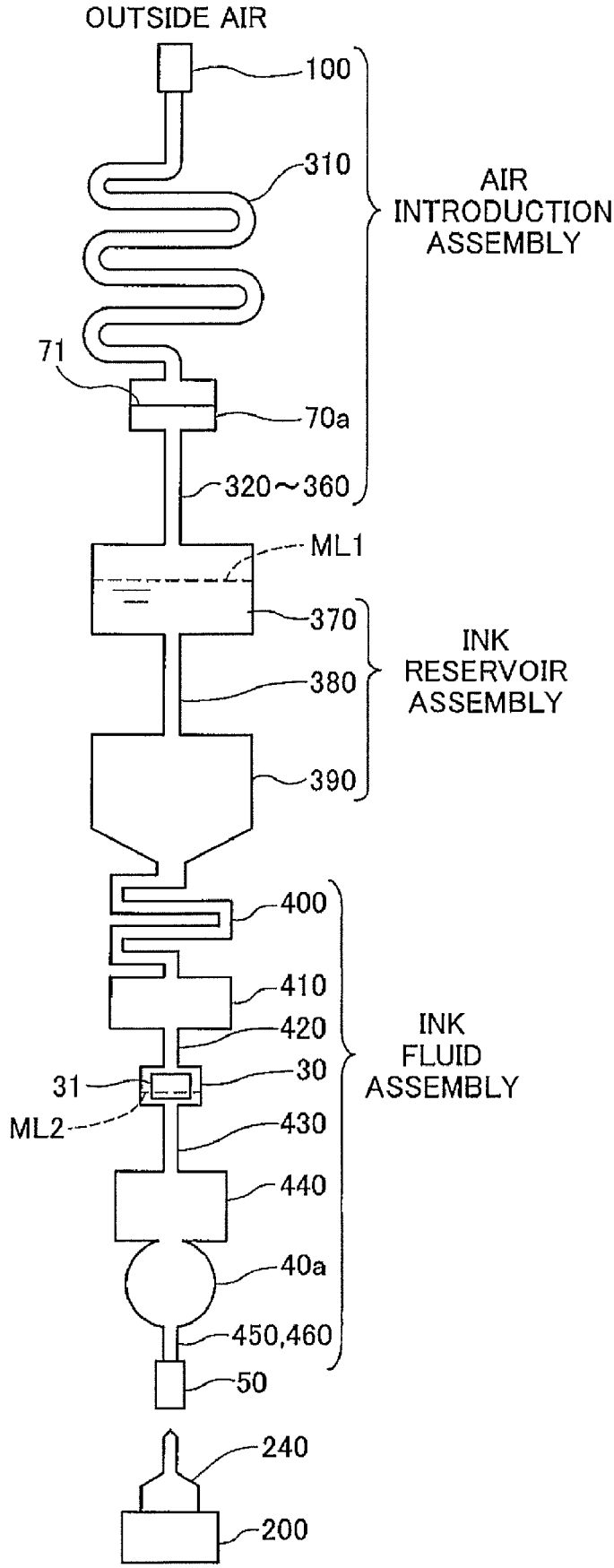
FIG. 6 is a conceptive view showing pathway from an air hole to a liquid feeder in the ink cartridge of the embodiment.

Among the air chambers 320 to 360 of the air introduction assembly shown in FIG. 6, the air chambers 320, 340, and 350 are provided on the front face of the cartridge body 10 (see FIGS. 11 and 13A), whereas the air chambers 330 and 360 are provided on the rear face of the cartridge body 10 (see FIGS. 12 and 13B). The respective air chambers 320 to 360 are arranged in series in this sequence from the upstream to the downstream to form one flow path. Part of the inner wall of the air chambers 320 and 330 forms the top face of the cartridge body 10, while part of the inner wall of the air chambers 340 and 350 forms the right lateral face of the cartridge body 10. A communication hole 322 is formed to connect the gas liquid separation chamber 70*a* with the air chamber 320. Communication holes 321 and 341 are respectively formed to connect the air chamber 320 with the air chamber 330 and to connect the air chamber 330 with the air chamber 340. The air chambers 340 and 350 are interconnected via a cutout 342 formed in a rib parting the air chamber 340 from the air chamber 350. Communication holes 351 and 372 are respectively formed to connect the air chamber 350 with the air chamber 360 and to connect the air chamber 360 with the tank chamber 370. The sterical arrangement of the mutually parted air chambers 320 to 360 effectively prevents the backflow of ink from the tank chamber 370 to the gas liquid separation chamber 70*a*.

The bubble trap flow path 400 and the bubble trap chamber 410 of the ink fluid assembly are provided at a specific position close to the liquid feeder 50 on the front face of the cartridge body 10 as shown in FIGS. 11 and 13A. The end chamber 390 has an inlet 401 communicating with the bubble trap flow path 400. The bubble trap flow path 400 has the four cylindrical flow paths interconnected with upward turndowns between the rear face and the front face of the cartridge body 10 to communicate with the bubble trap chamber 410 via an outlet 402. The sensor unit 30 is located in a lower area of the left lateral face of the cartridge body 10 as mentioned previously with reference to FIG. 4 (see FIGS. 11, 12, 13A, and 13B).

The first fluid path 420 connecting the bubble trap chamber 410 with the sensor unit 30 and the second fluid path 430 connecting the sensor unit 30 with the buffer chamber 440 are formed on the rear face of the cartridge body 10 as shown in FIGS. 12 and 13A. The bubble trap chamber 410 has a communication hole 412 to connect the bubble trap chamber 410 to the first fluid path 420. A communication hole 311 is formed to connect the first fluid path 420 with the sensor unit 30. Communication holes 312 and 441 are respectively formed to connect the sensor unit 30 with the second fluid path 430 and to connect the second fluid path 430 with the buffer chamber 440.

The buffer chamber 440, the third fluid path 450, and the fourth fluid path 460 are formed in a specific area close to the left side on the front face of the cartridge body 10 as shown in FIGS. 11 and 13A. A communication hole 441 is formed to connect the downstream end of the second fluid path 430 with the buffer chamber 440. A communication hole 442 is formed to directly connect the buffer chamber 440 with the differential pressure regulator chamber 40*a*. A communication hole 451 is formed to connect the differential pressure regulator chamber 40*a* with the third fluid path 450. A communication hole 452 is formed to connect the third fluid path 450 with the fourth fluid path 460 provided inside the liquid feeder 50.

The ink cartridge 1 has spaces 501 and 503 as shown in FIGS. 11 and 13A. The spaces 501 and 503 are non-fill chambers that are not filled with ink. The non-fill chambers 501 and 503 are separated from the pathway from the air hole 100 to the liquid feeder 50. An air communication hole 502 is formed on the rear side of the non-fill chamber 501 to communicate with the outside air. Similarly an air communication hole 504 is formed on the rear side of the non-fill chamber 503 to communicate with the outside air. The non-fill chambers 501 and 503 work as deaeration chambers with accumulation of negative pressure during packaging of the ink cartridge 1 under reduced pressure. In the packaged ink cartridge 1, the internal pressure of the cartridge body 10 is kept at or below a specified low pressure level. This structure ensures supply of ink containing little amount of dissolved air.

Figure 14:
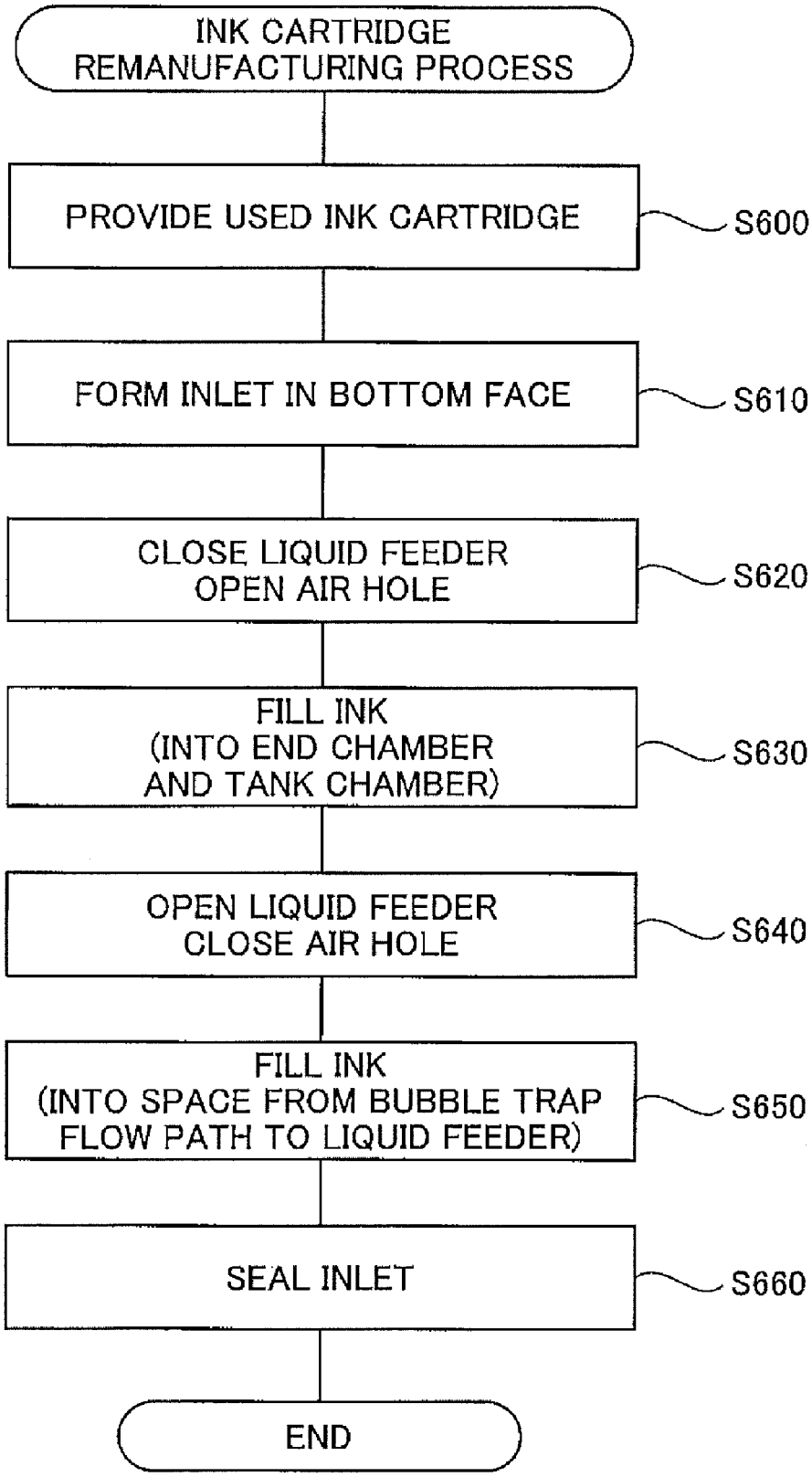
FIG. 14 is a flowchart showing a processing flow of ink cartridge remanufacturing process.
Figure 15:
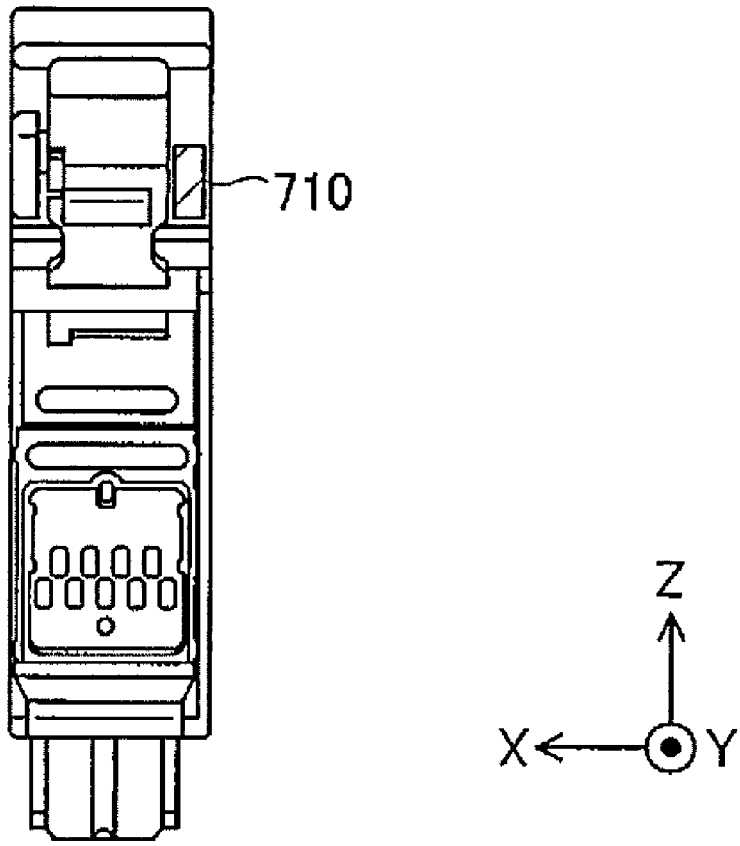
FIG. 15 is an explanatory view showing an inlet formation area for formation of an inlet on a left lateral face of the cartridge body.

B. Ink Cartridge Remanufacturing Process:

A remanufacturing process of the ink cartridge 1 in the embodiment of the invention is discussed below with reference to the flowchart of FIG. 14. When the level of ink remaining in the ink cartridge 1 decreases to or below a specified level by the ink consumption, the ink cartridge remanufacturing process is performed to detach the used ink cartridge 1 from the carriage 200 of the ink-jet printer and refill the ink into the used ink cartridge 1. This process is equivalent to the ink refill process and remanufactures the ink cartridge 1 as a new ink cartridge. The processing flow of the ink cartridge remanufacturing process first provides the used ink cartridge 1 with consumption of ink (step S600). The processing flow subsequently detaches the cover member 20 from the ink cartridge 1 and forms an inlet 720 (defined by inlet holes 720*a* and 720*b*) in a front-side area from the catch lever 11 on the left lateral face of the cartridge body 10 to pass through the inner wall of the non-fill chamber 501 and communicate with the buffer chamber 440 (step S610). In the illustrated example of FIG. 15, the inlet 720 is formed in a hatched inlet formation area 710 on the left lateral face of the cartridge body 10. The inlet 720 may be pierced through the inner walls of the non-fill chambers 501 and 503. In this embodiment, the inlet 720 of 6 mm in diameter is bored with a drill. The inlet formation area 710 corresponds to a sectional area shown by a thick line on the left lateral face of the cartridge body 10 shown in FIG. 13A.

After formation of the inlet 720, the processing flow closes the liquid feeder 50 and opens the air hole 100 (step S620). In the ordinary state, the sealing film 90 for sealing the air hole 100 is peeled off by the user to open the air hole 100 at the time of attachment of the ink cartridge 1 to the carriage 200 of the ink-jet printer. The liquid feeder 50 is closed by the spring washer 52 and the seal member 51 that are pressed by the closing spring 53. Namely this step of closing the liquid feeder 50 and opening the air hole 100 is not essential.

Figure 16:
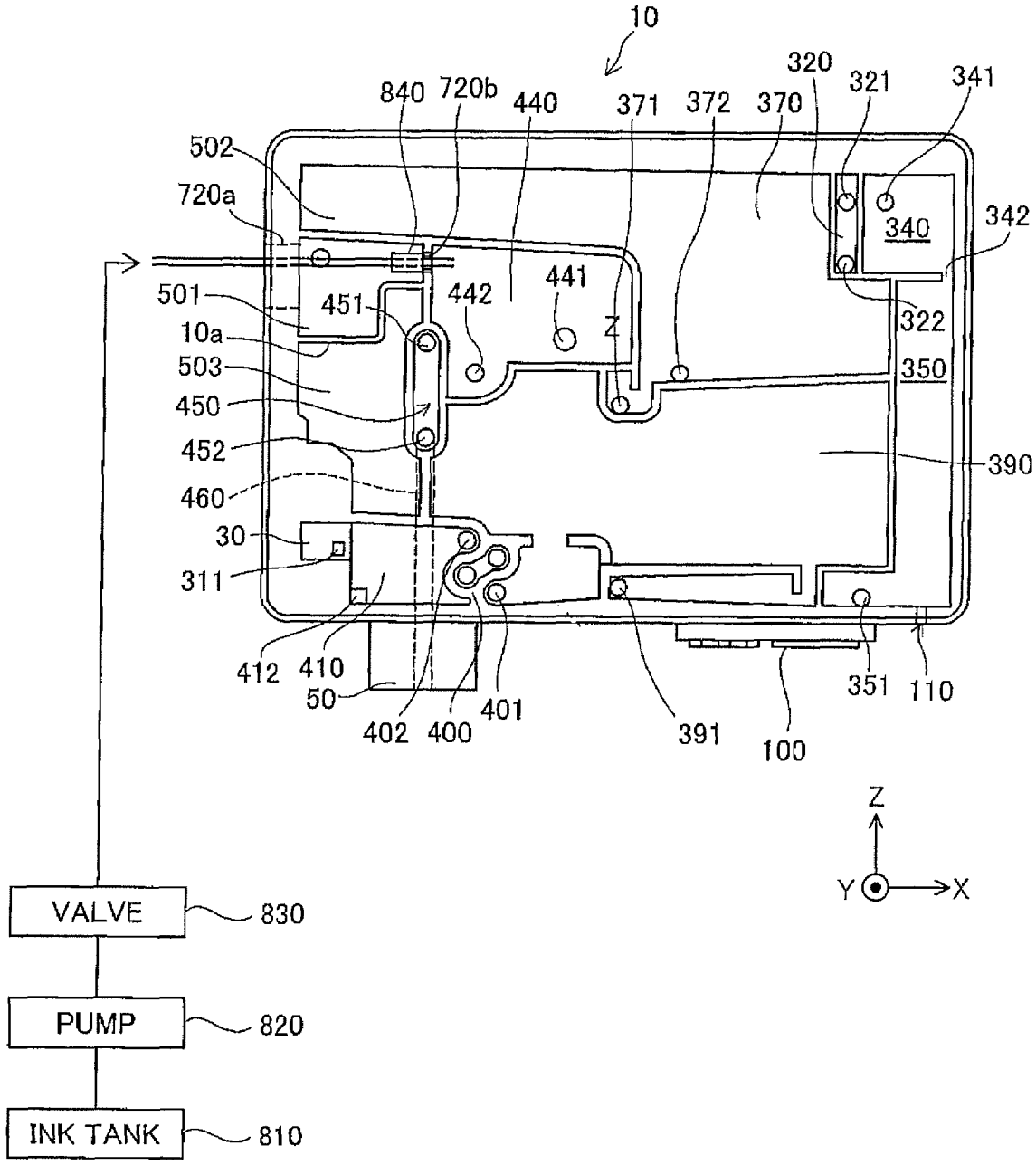
FIG. 16 shows one phase of ink ejection in the ink cartridge remanufacturing process.

After closing the liquid feeder 50 and opening the air hole 100, the processing flow fills the ink through the inlet 720 (step S630). A concrete procedure of this embodiment inserts a rubber sealed tube 840 through the inlet hole 720*a* to bring the seal rubber in contact with the inlet hole 720*b* and connects a valve 830, a pump 820, and an ink tank 810 via tubes with the rubber sealed tube 840 as shown in FIG. 16. The procedure activates the pump 820 and adjusts the valve 830 to inject the ink stored in the ink tank 810 into the buffer chamber 440. Sealing the inlet hole 720*b* during the ink fill is not essential but is preferable to ensure the efficient ink fill and prevent leakage of ink out of the cartridge body 10. The ink fill continues until the ink level reaches a specific position in the tank chamber 370. Since a transparent film is used for the ink 80 in this embodiment, the ink fill to the specific position is checked visually. A preset amount of ink may be filled in the automated ink fill process or in application of an opaque film for the film 80. In the closed state of the liquid feeder 50, the injected ink does not flow in the downstream of the buffer chamber 440.

This ink filling technique is only illustrative but is not restrictive in any sense. Any of other diverse techniques, for example, a technique using a syringe, may be adopted to fill the ink.

Figure 17:
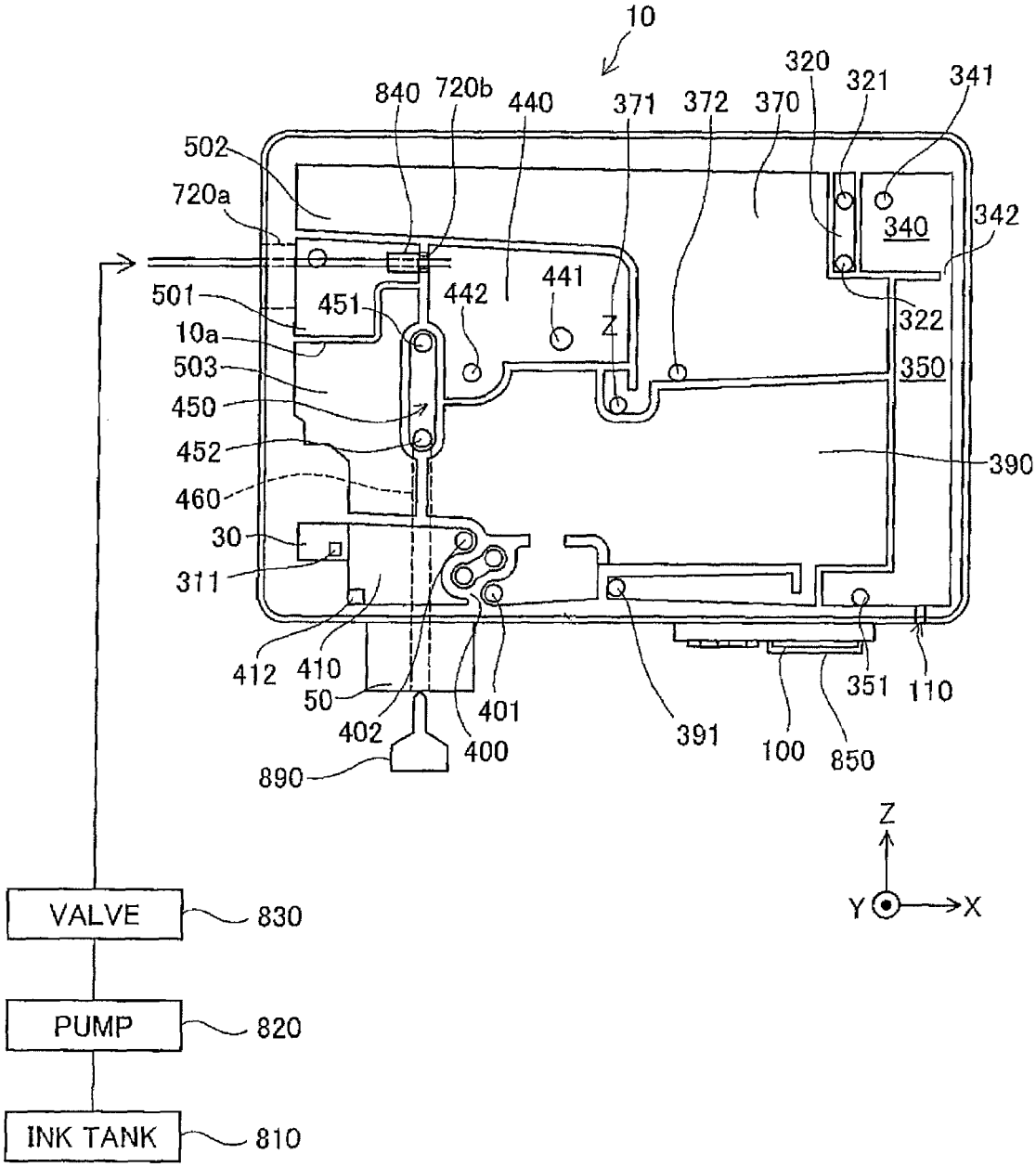
FIG. 17 shows another phase of ink ejection in the ink cartridge remanufacturing process.

After filling the ink, the processing flow opens the liquid feeder 50 and closes the air hole 100 (step S640). A concrete procedure of this embodiment uses a seal cap 850 to close and seal the air hole 100 and inserts an ink supply needle 890 into the liquid feeder 50 as shown in FIG. 17. The ink supply needle 890 has a similar shape to that of the ink supply needle 240 of the carriage 200. Insertion of the ink supply needle 890 pushes up the spring washer 52, which is pressed down by the closing spring 53, toward the top face of the cartridge body 10 and makes a gap between the closing spring 53 and the spring washer 52 to open the liquid feeder 50.

After opening the liquid feeder 50 and closing the air hole 100, the processing flow again fill the ink through the inlet 720 (step S650). In the closed state of the air hole 100 and the open state of the liquid feeder 50, the injected ink does not flow into the tank chamber 370 but flows in the downstream to fill up the space to the liquid feeder 50.

After filling the ink, the processing flow removes the seal cap 850 from the air hole 100, seals the inlet 720 with a preset seal member, and attaches the cover member 20 to the cartridge body 10 (step S660). A concrete procedure of the embodiment applies a synthetic resin film to the inlet hole 720*b* and its periphery on the left lateral face of the cartridge body 10 with an adhesive to seal the inlet hole 720*b*. This sealing technique is, however, only illustrative but is not restrictive in any sense. Any of other diverse techniques may be adopted to seal the inlet hole 720*b* in an air-tight manner; for example, welding a film, setting in a seal plug made of a rubber or synthetic resin material, or applying an adhesive to the inlet hole 720*b* and its periphery. The series of processing discussed above completes the ink cartridge remanufacturing. In this embodiment, for the better workability at step S660, the inlet hole 720*a* is made to be greater in dimensions than the inlet hole 720b.

The ink cartridge remanufacturing process of this embodiment fills ink into the buffer chamber 440 that is not adjacent to and does not directly communicate with the bubble trap flow path 400. The buffer chamber 440 communicates with the bubble trap flow path 400 via the bubble trap chamber 410, the first fluid path 420, and the second fluid path 430. In the ink cartridge remanufacturing process shown in the flowchart of FIG. 14, even if the shavings of the cartridge body 10 produced in the course of formation of the inlet holes 720*a* and 720*b* move into the buffer chamber 440 and are mixed into the injected ink, the sufficient length of the pathway and the sterical arrangement of the pathway from the buffer chamber 440 to the bubble trap flow path 400 effectively prevents the shavings mixed into the ink from reaching the bubble trap flow path 400. This arrangement desirably prevents the blockage of the bubble trap flow path 400 having a relatively small flow path diameter or the increasing flow resistance of the bubble trap flow path 400 due to accumulation of the shavings in the bubble trap flow path 400. This arrangement also prevents the occurrence of edges in the cylindrical flow paths due to accumulation of the shavings in the bubble trap flow path 400 and thereby maintains the functions of the bubble trap flow path 400. Namely the ink cartridge remanufacturing process of the embodiment ensures the liquid refill without damaging the functions of the cartridge body 10.

The ink cartridge remanufacturing process of the embodiment fills the ink in the state of opening the liquid feeder 50 and closing the air hole 100 and thus enables the ink injected through the inlet hole 720*b* to be smoothly introduced into the pathway of ink from the buffer chamber 440 to the liquid feeder 50. The ink cartridge remanufacturing process of the embodiment fills the ink in the state of closing the liquid feeder 50 and opening the air hole 100 and thus enables the ink injected through the inlet hole 720*b* to be smoothly introduced into the pathway of ink from the buffer chamber 440 to the tank chamber 370.

In the ink cartridge 1 with the ink refilled according to the ink cartridge remanufacturing process discussed above, the inlet hole 720*b* formed for the ink refill is sealed with the film. Such sealing of the inlet hole 720*b* does not damage the functions of the ink cartridge 1. The ink refill through the inlet hole 720*b* is easily performed many times by the simple peel-off of the film.

C. Modifications

C-1. Modification 1:

The ink cartridge remanufacturing process of the embodiment opens and closes the air hole 100 at the ink filling step. One modification may keep the air hole 100 in the closed position and form another hole in the flat surface of the air chambers 320 to 360 to open and close the hole at the ink filling step. The hole formed in the flat surface is more readily opened and closed than the air hole 100 formed in the non-flat surface.

C-2. Modification 2

The ink cartridge remanufacturing process of the embodiment first fills ink into the upstream of the buffer chamber 440 (step S630) and subsequently fills ink into the downstream of the buffer chamber 440 (step S650). This sequence is, however, not essential but may be reversed. Filling ink in the downstream prior to filling ink in the upstream may cause the shavings entering through the inlet hole 720*b* to move on the flow of the injected ink to the downstream. In this case, the shavings move away from the bubble trap flow path 400 and may be discharged from the liquid feeder 50. This accordingly enhances the effect of preventing the shavings from reaching the bubble trap flow path 400. It is preferable to fill ink with air suction out of the cartridge body 10, for example, by inserting a needle into the liquid feeder 50 and sucking the air with a vacuum pump. This further facilitates the discharge of the shavings and further enhances the above effect. In the structure of discharging the shavings from the liquid feeder 50, ink may be filled into the space in the upstream of the bubble trap flow path with air suction from the upstream location (for example, the air hole 100) in the cartridge body 10. This arrangement ensures smoother and quicker ink filling in the upstream. Either one of the ink filling step in the upstream and the ink filling step in the downstream may be omitted according to the requirements.

C-3. Modification 3

Figure 18A:
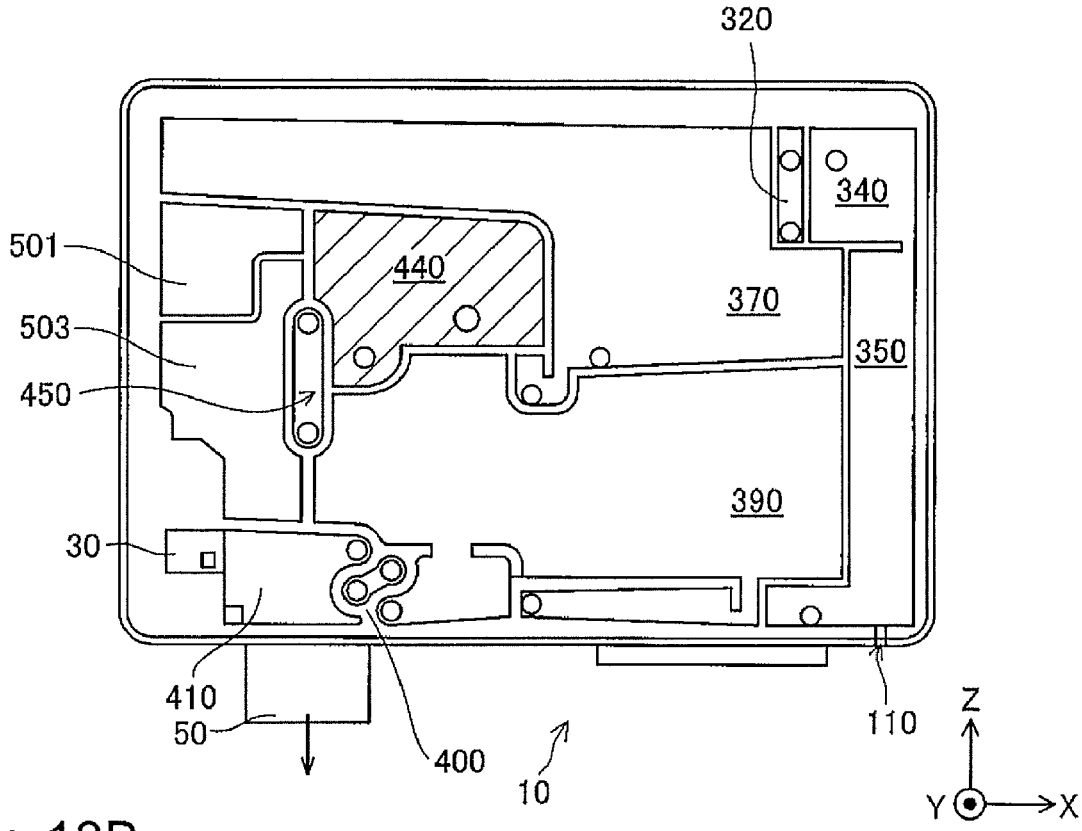
FIGS. 18A and 18B show the positions of formation of the inlet in modified structures.
Figure 18B:
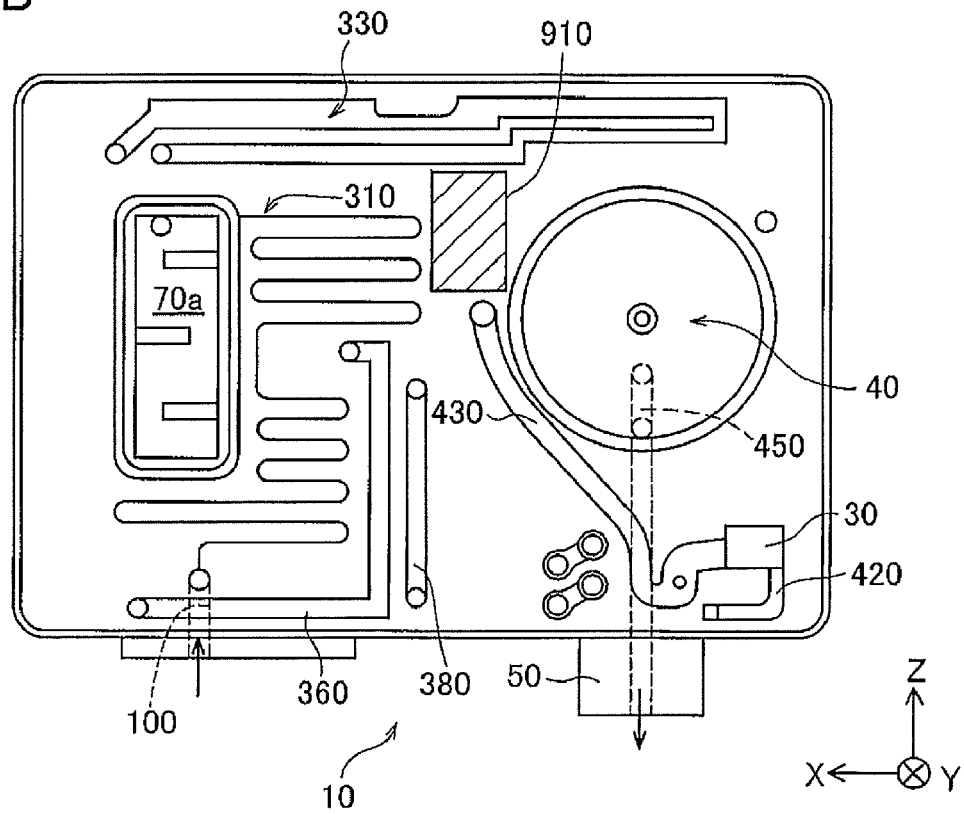

The ink cartridge remanufacturing process of the embodiment forms the inlet holes 720*a* and 720*b* connecting with the buffer chamber 440 in the inlet formation area 710 on the left lateral face of the cartridge body 10. The location of inlet formation is, however, not restricted to this area. An inlet may be formed on the film 80 applied on the front face of the cartridge body 10 as shown by a hatched area in FIG. 18A. An inlet may otherwise be formed in a specific area 910 on the outer surface film 60 applied on the rear face of the cartridge body 10 as shown by a hatched area in FIG. 18B.

C-4. Modification 4

Figure 19A:
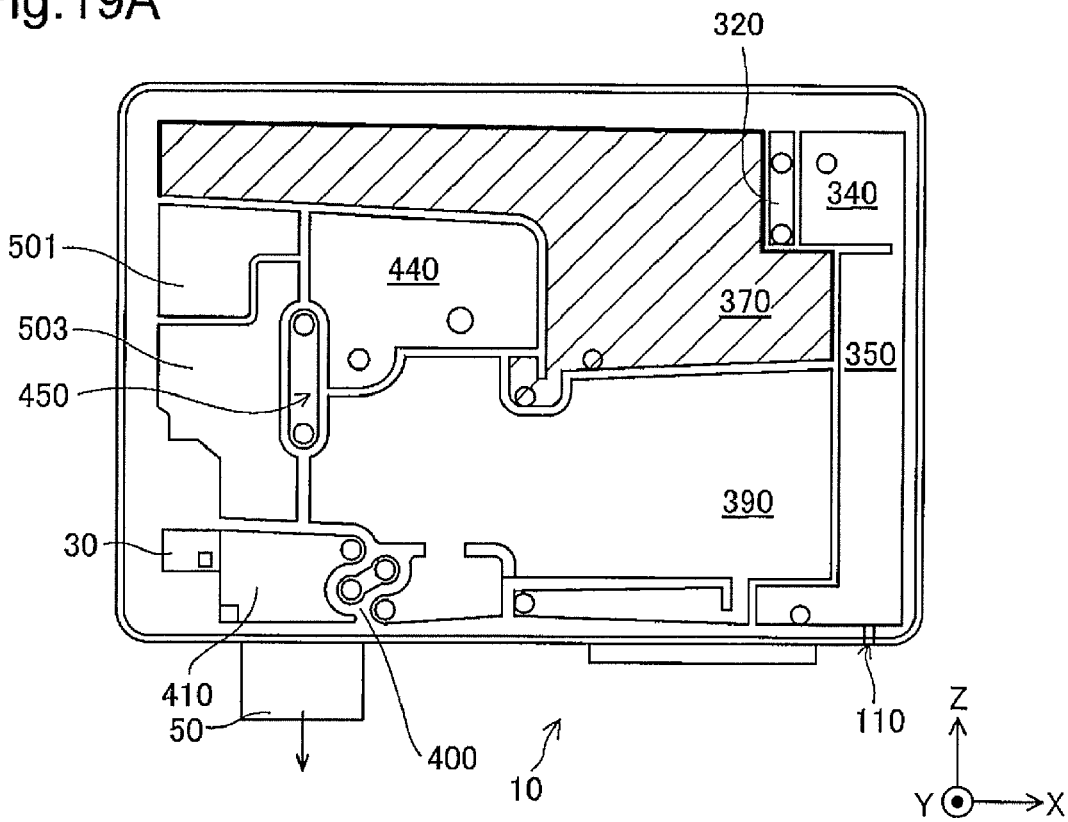
FIGS. 19A and 19B show the positions of formation of the inlet in other modified structures.
Figure 19B:
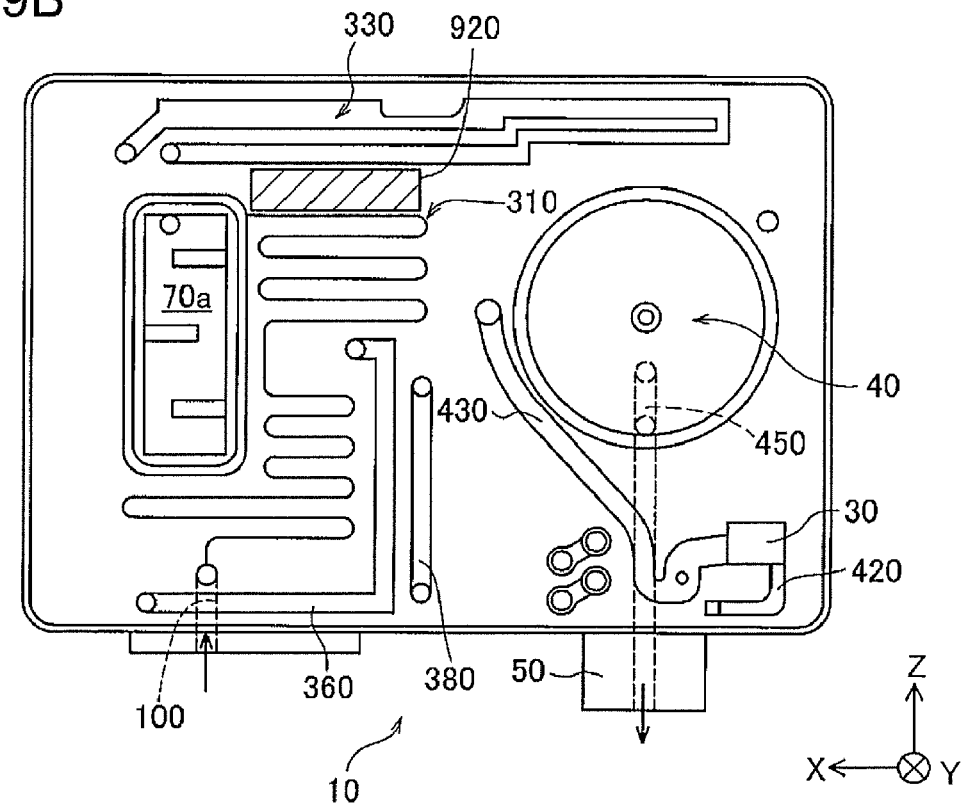

In the embodiment and its modified examples discussed above, the ink cartridge remanufacturing process injects ink into the buffer chamber 440. The location of ink injection is, however, not restricted to the buffer chamber 440 but may be the tank chamber 370. In one modified structure, an inlet may be formed on the film 80 applied on the front face of the cartridge body 10 as shown by a hatched area in FIG. 19A. In another modified structure, an inlet may be formed in a specific area 920 on the outer surface film 60 applied on the rear face of the cartridge body 10 as shown by a hatched area in FIG. 19B.

Figure 20A:
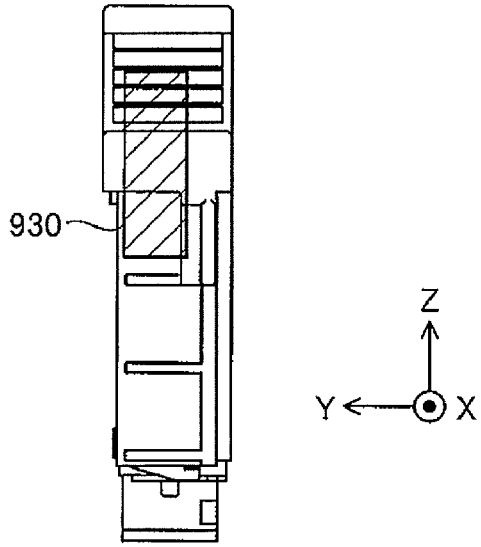
FIGS. 20A, 20B, and 20C show the positions of formation of the inlet in other modified structures.
Figure 20B:
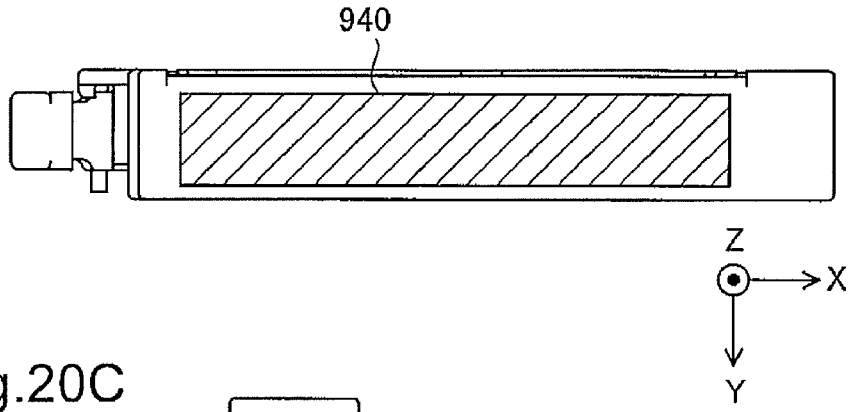
Figure 20C:
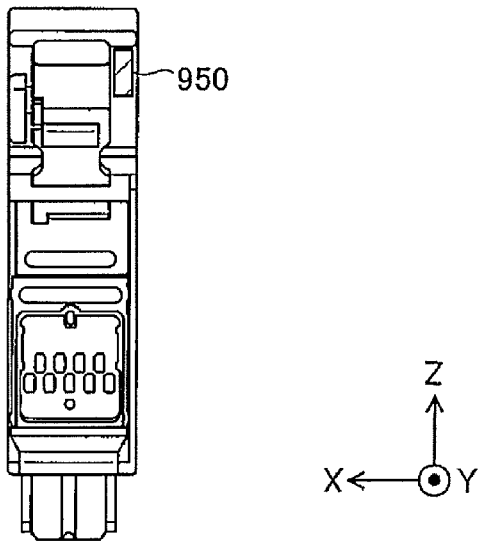

In still another modified structure, an inlet may be formed in a specific area 930 on the right lateral face of the cartridge body 10 to be pierced through the air chamber 350 or the air chambers 340 and 320 as shown in FIG. 20A. In this case, the inlet may pass through the right lateral face of the cartridge body 10 and the inner wall defined by the air chamber 350 and the tank chamber 370 or pass through the right lateral face of the cartridge body 10, the inner wall defined by the air chamber 340 and the air chamber 320, the inner wall defined by the air chamber 320 and the tank chamber 370. In another modified structure, an inlet may be formed in a specific area 940 on the top face of the cartridge body 10 to directly connect with the tank chamber 370 or pass through the air chamber 330 as shown in FIG. 20B. In still another modified structure, an inlet may be formed in a specific area 950 on the left lateral face of the cartridge body 10 to directly connect with the tank chamber 370 as shown in FIG. 20C. The cross section of the tank chamber 370 as a possible location of inlet formation is shown by a thick line in FIG. 19A.

The inlet is thus required to be formed in the area other than the specific section, for example, any of various ink chambers and flow paths, adjoining to and directly communicating with the bubble trap flow path 400 (the end chamber 390 and the bubble trap chamber 410 in the structure of the embodiment). Formation of the inlet in the area other than the ink chambers and flow paths adjoining to and directly communicating with the bubble trap flow path 400 effectively prevents the shavings mixed into ink in the course of formation of the inlet from reaching the bubble trap flow path 400.

C-5. Modification 5

Figure 21:
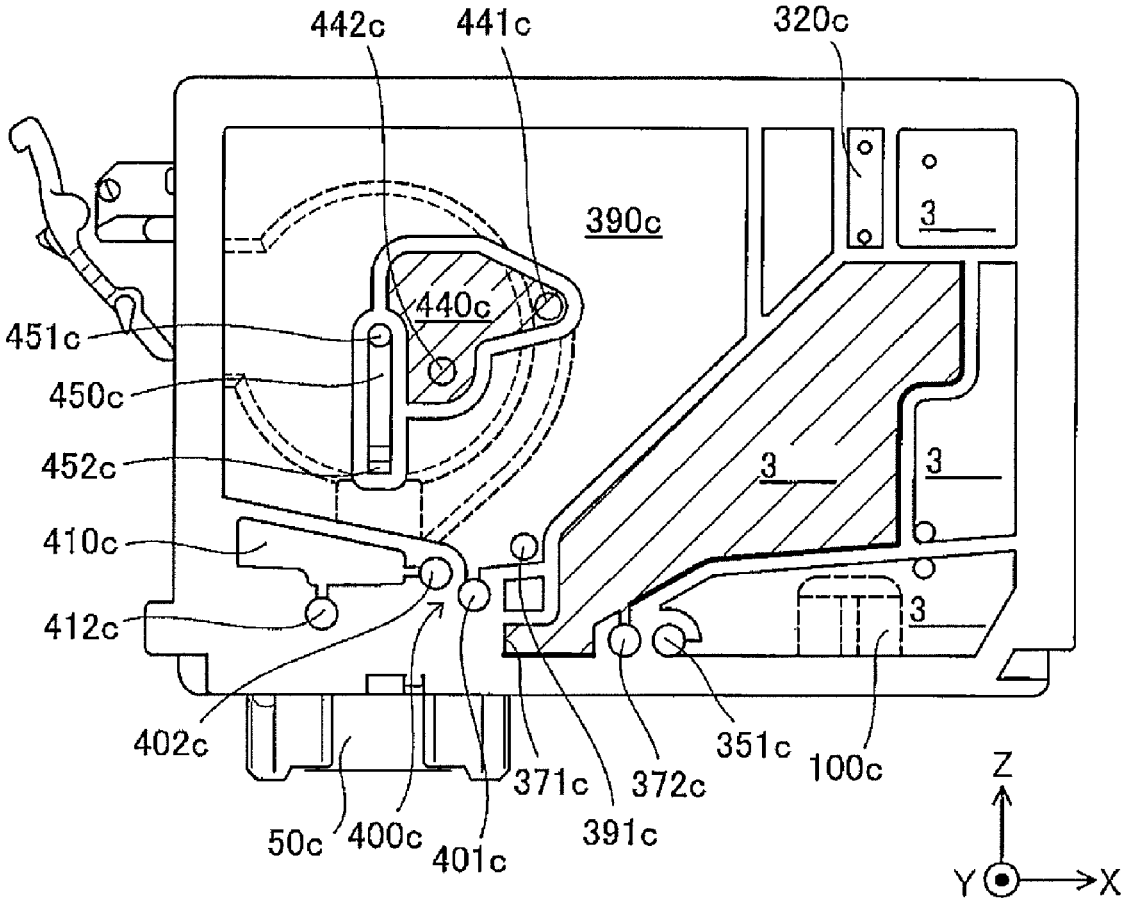
FIG. 21 shows the position of formation of an inlet in a cartridge body of one modified example.

The embodiment describes the remanufacturing process of the ink cartridge 1 designed to have the structure shown in FIGS. 1 through 9. The ink cartridge remanufacturing process of the invention is, however, not restricted to the ink cartridge 1 having the structure of the embodiment but is also applicable to an ink cartridge having a different structure, for example, an ink cartridge 1*c* shown in FIG. 21. FIG. 21 is a front view schematically showing a cartridge body 10*a* c of the ink cartridge 1*c*. The like elements in the cartridge body 10*a* c of this modified example to those in the cartridge body 10 of the embodiment shown in FIGS. 11, 13A, and 13B are expressed by the like numerals with a symbol 'c' as a suffix and are not specifically described here, The cartridge body 10*c* of this modified example has the similar structure to that of the cartridge body 10 of the embodiment, except that a tank chamber 370*c* is located on the bottom side and an end chamber 390*c* is located on the top side, that the air chamber 350 is parted into two air chambers 350*c* and 355*c*, that a sensor unit 30*c* is arranged behind a bubble trap chamber 410*c* (not shown), and that the bottom face and the top face are longer in the Y-axis direction. In the structure of the embodiment, the bubble trap flow path 400 has the four cylindrical flow paths that are extended substantially in parallel with the bottom face and are interconnected with upward turndowns between the rear face and the front face of the cartridge body 10.

In the cartridge body 10*a* c of this modified example, an inlet may be formed in a bottom face or in a right lateral face as shown by a thick-line sectional area in FIG. 21. An inlet may otherwise be formed on a film 80*c* applied on the front face of the cartridge body 10*a* c as shown by a hatched area in FIG. 21.

The ink cartridge used for the ink cartridge remanufacturing process of the invention is not restricted to the ink cartridge 1 having the structure discussed above. The ink cartridge remanufacturing process of the invention is applicable to an ink cartridge of any other structure equipped with the bubble trap flow path 400. The bubble trap flow path 400 is not restricted to the structure of the embodiment described previously but may be any other structure formed to have cylindrical flow paths turned down upward in a certain attitude of the cartridge body 10 attached to the printer and designed to exert the required functions discussed above.

The embodiment, its applications, and its modified examples discussed above are to be considered in all aspects as illustrative and not restrictive. The present invention may be embodied in other specific forms with some modifications, changes, and alterations without departing from the scope or spirit of the main characteristics of the present invention. The above embodiment and its modified examples describe the ink cartridge and the remanufacturing method of the ink cartridge as typical examples of the liquid container and the remanufacturing method of the liquid container. The principle of the invention is also actualized by a liquid refilling method and a liquid container used for the liquid refilling method. The technique of the invention is not restricted to the ink cartridge attached to the ink-jet printer but is also applicable to a liquid container designed to be attachable to and detachable from any of various liquid consuming devices and to store a liquid other than the ink. Typical examples of the liquid stored in such a liquid container include a dispersion or a solution of a material like an electrode material or a coloring material used to manufacture liquid crystal displays, EL (electroluminescence) displays, surface-emitting displays, and color filters, a liquid of a bioorganic material used to manufacture biochips, a sample liquid used for precision pipettes, lubricating oil used for pinpoint ejection to an object precision machine, such as a watch or a camera, a transparent resin solution of, for example, an ultraviolet curable resin ejected onto a substrate to manufacture a hemispherical micro-lens (optical lens) used for an optical communication element, and an acid or alkali etching solution used to etch a substrate.

What is claimed is:

1. A method of filling a liquid into a liquid container designed to be attachable to and detachable from a liquid consuming device and to store the liquid, which is to be supplied to the liquid consuming device, providing a liquid container comprising: a first chamber arranged to store the liquid therein and positioned to define a downstream direction of fluid flow from the liquid container to a liquid consuming device; a second chamber located downstream of the first chamber and arranged to be in liquid communication with the first chamber and store the liquid therein; sensor unit located downstream of the second chamber and arranged to receive therein a sensor for detecting a consumption level or a remaining level of the liquid; a liquid feeder located downstream of the sensor unit and arranged to supply the liquid stored in the first chamber and in the second chamber to the liquid consuming device; an air open structure in fluid communication with the air outside the liquid container arranged to place the first chamber in fluid communication with the outside air via an air communication path; a bubble trap flow path located upstream of the sensor unit and downstream of the second chamber and designed to trap bubbles; and a bubble trap chamber located downstream of the bubble trap flow path and upstream of the sensor unit and designed to trap bubbles;

the liquid filling method comprising:

forming an inlet in an area other than a section adjoining to and directly communicating with the bubble trap flow path in a pathway of the liquid;

injecting a liquid through the inlet; and sealing the inlet after the injection of the liquid.

2. The liquid filling method according to claim 1, wherein a third chamber is included in the pathway of the liquid between the bubble trap chamber and the liquid feeder and the inlet is formed in the third chamber.

3. A method of remanufacturing a liquid container designed to be attachable to and detachable from a liquid consuming device and to store a liquid, which is to be supplied to the liquid consuming device, the remanufacturing method comprising:

providing a liquid container, structured to include: a first chamber arranged to store the liquid therein and positioned to define a downstream direction from the liquid container to a liquid consuming device; a second chamber located downstream of the first chamber and arranged to be in liquid communication with the first chamber and to store the liquid therein; a sensor unit located downstream of the second chamber and arranged to receive therein a sensor for detecting a consumption level or a remaining level of the liquid; a liquid feeder located downstream of the sensor unit and arranged to supply the liquid stored in the first chamber and in the second chamber to the liquid consuming device; an air open structure in fluid communication with the air outside the liquid container arranged to place the first chamber in fluid communication with the outside air via an air communication path; a bubble trap flow path located upstream of the sensor unit and downstream of the second chamber, and designed to trap bubbles; and a bubble trap chamber located downstream of the bubble trap flow path and upstream of the sensor unit and designed to trap bubbles;

forming an inlet in an area other than a section adjoining to and directly communicating with the bubble trap flow path in a pathway of the liquid;

injecting a liquid through the inlet; and sealing the inlet after the injection of the liquid.

4. The remanufacturing method according to claim 3, wherein a third chamber is included in the pathway of the liquid between the bubble trap chamber and the liquid feeder and the inlet is formed in the third chamber.

5. A liquid container constructed to be attachable to and detachable from a liquid consuming device and to store a liquid, which is to be supplied to the liquid consuming device, the liquid container comprising:

a first chamber arranged to store the liquid therein and positioned to define a downstream direction from the liquid container to a liquid consuming device;

a second chamber located downstream of the first chamber and arranged to be in liquid communication with the first chamber and to store the liquid therein;

a sensor unit located downstream of the second chamber and arranged to receive therein a sensor for detecting a consumption level or a remaining level of the liquid;

a liquid feeder located downstream of the sensor unit and arranged to supply the liquid stored in the first chamber and in the second chamber to the liquid consuming device;

an air open structure in fluid communication with the air outside the liquid container arranged to place the first chamber in fluid communication with the outside air via an air communication path;

a bubble trap flow path located upstream of the sensor unit and downstream of the second chamber and designed to trap bubbles;

a bubble trap chamber located downstream of the bubble trap flow path and upstream of the sensor unit and designed to trap bubbles;

an inlet formed in an area other than a section adjoining to and directly communicating with the bubble trap flow path in a pathway of the liquid to allow injection of the liquid; and a sealing member structured to seal the inlet.

6. The liquid container according to claim 5, wherein a third chamber is included in the pathway of the liquid between the bubble trap chamber and the liquid feeder and the inlet is formed in the third chamber.

* * * * *